US009163590B2

(12) United States Patent
Takeishi et al.

(10) Patent No.: US 9,163,590 B2
(45) Date of Patent: Oct. 20, 2015

(54) VAPORIZED-FUEL PROCESSING SYSTEM

(71) Applicant: DENSO CORPORATION, Kariya, Aichi-pref. (JP)

(72) Inventors: Hiroaki Takeishi, Obu (JP); Hiroshi Katsurahara, Okazaki (JP); Mitsuyuki Kobayashi, Gamagori (JP)

(73) Assignee: DENSO CORPORATION, Kariya (JP)

( * ) Notice: Subject to any disclaimer, the term of this patent is extended or adjusted under 35 U.S.C. 154(b) by 511 days.

(21) Appl. No.: 13/755,890

(22) Filed: Jan. 31, 2013

(65) Prior Publication Data

US 2013/0199504 A1 Aug. 8, 2013

(30) Foreign Application Priority Data

Feb. 3, 2012 (JP) ..... 2012-21501

(51) Int. Cl.
*F02M 25/08* (2006.01)

(52) U.S. Cl.
CPC ..... *F02M 25/0809* (2013.01)

(58) Field of Classification Search
CPC . F02D 41/02; F02D 41/14; F02D 2200/0602; F02M 25/08; F02M 25/0801; F02M 25/0809; F02M 25/0836; F02M 25/0702
USPC ..... 123/516–521, 528, 529; 701/114; 73/114.39, 114.43
See application file for complete search history.

(56) References Cited

U.S. PATENT DOCUMENTS 5,954,034 A * 9/1999 Takagi ..... 123/520
2002/0161495 A1* 10/2002 Yamaki ..... 701/33
2005/0257607 A1* 11/2005 Suzuki ..... 73/118.1
2006/0179928 A1* 8/2006 Shikama et al. ..... 73/118.1
2007/0256669 A1* 11/2007 Jo ..... 123/519
2010/0223984 A1* 9/2010 Pursifull et al. ..... 73/114.39
2013/0081600 A1* 4/2013 Fukui et al. ..... 123/520

FOREIGN PATENT DOCUMENTS

JP 2003-74423 3/2003

OTHER PUBLICATIONS

2011 My OBD System Operation Summary for Gasoline Engines, Ford Motor Company, http://www.motorcraftservice.com/vdirs/retail/default.asp?pageid=diad_theory_retail&gutsid=diagsheet&kevin=rules; revision date Apr. 21, 2010, 3 pages.

* cited by examiner

*Primary Examiner* — John Kwon
*Assistant Examiner* — Johnny H Hoang
(74) *Attorney, Agent, or Firm* — Nixon & Vanderhye PC

(57) ABSTRACT

A first purge passage is connected to an intake-air passage at a downstream side of a throttle valve. A second purge passage is connected to the intake-air passage at an upstream side of a supercharging device. A first and a second check valve are respectively provided in the first and second purge passages. A control unit determines to which operating condition (from a first to a third operating condition) engine operation corresponds, based on downstream-side and upstream-side pressure of the throttle valve. A change of in-tank pressure of a fuel tank is detected in a condition that an air-communication valve is closed but a purge control valve is opened. The control unit diagnoses which of the valves is not normally operated and whether such valve is fixed to a valve opened or a valve closed position, based on the change of in-tank pressure for each of engine operating conditions.

11 Claims, 11 Drawing Sheets

FIG. 2A
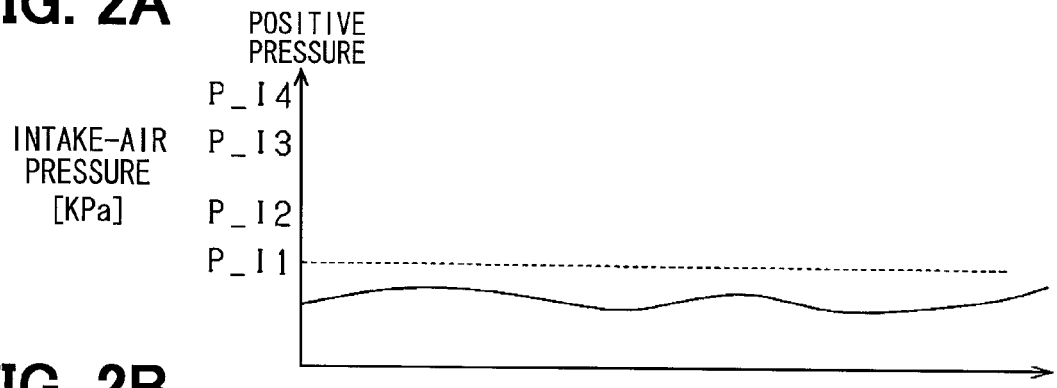
FIG. 2B
FIG. 2C
FIG. 2D
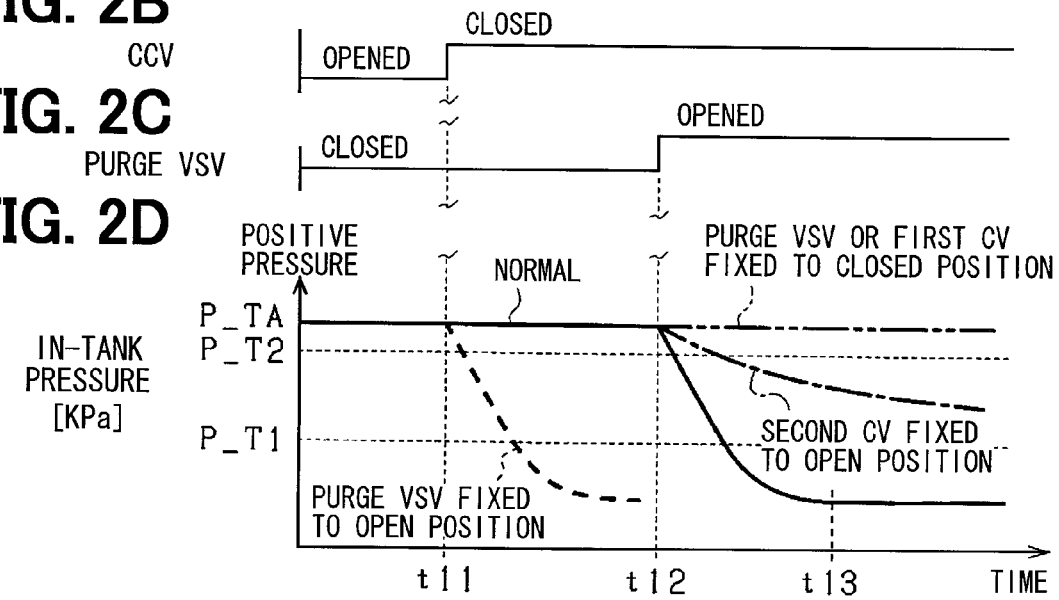
FIG. 3
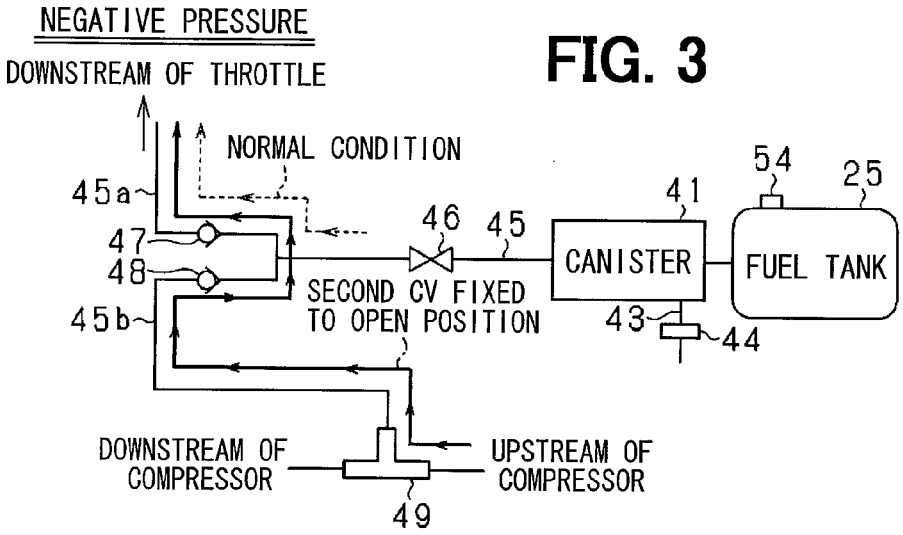

FIG. 4A
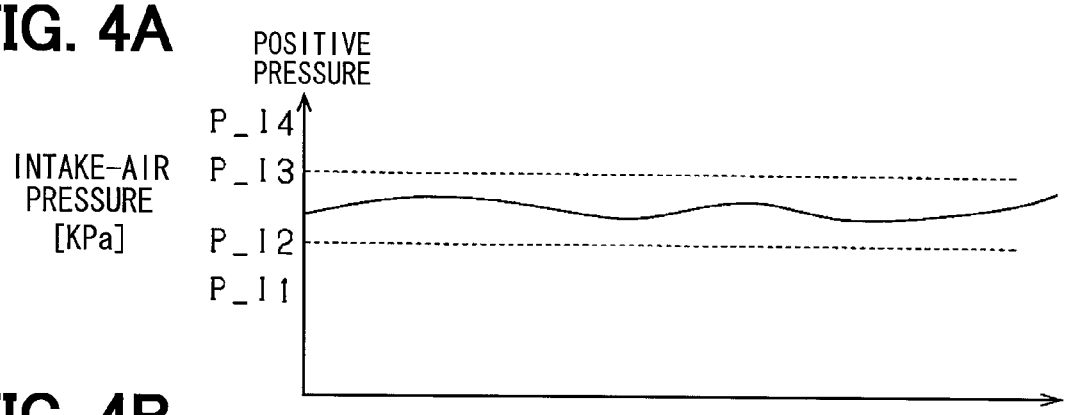
FIG. 4B
FIG. 4C
FIG. 4D
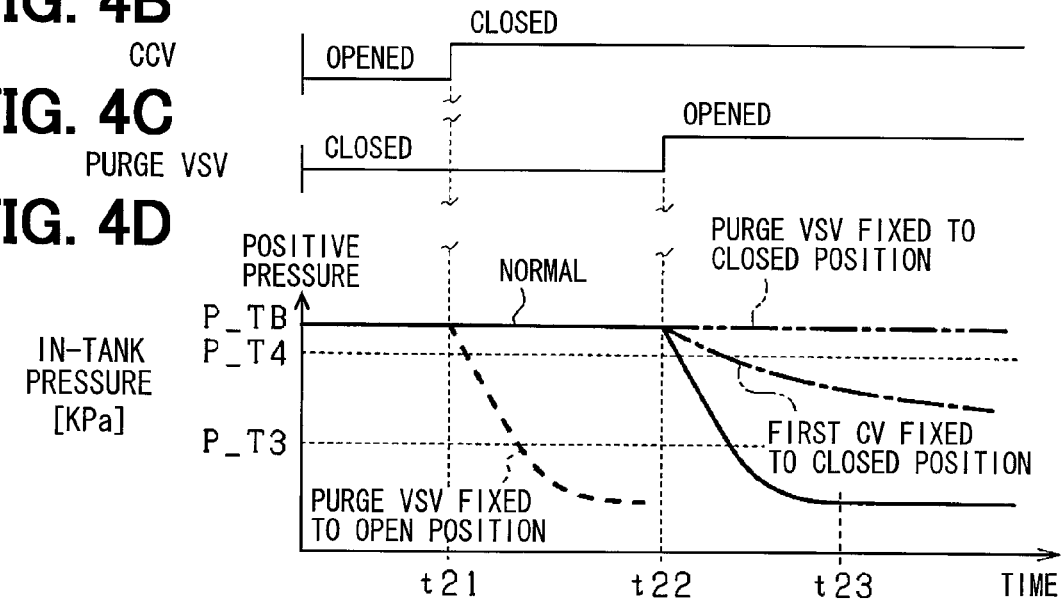
FIG. 5
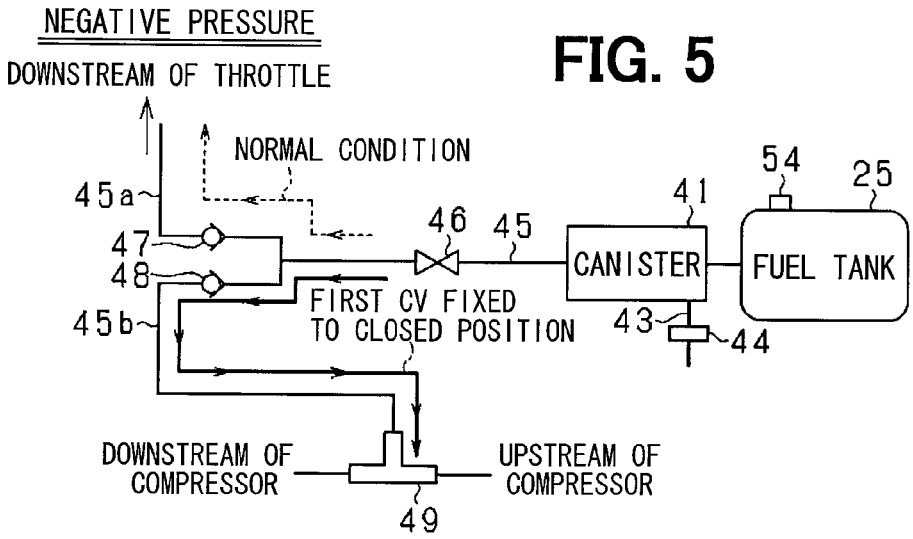

FIG. 6A
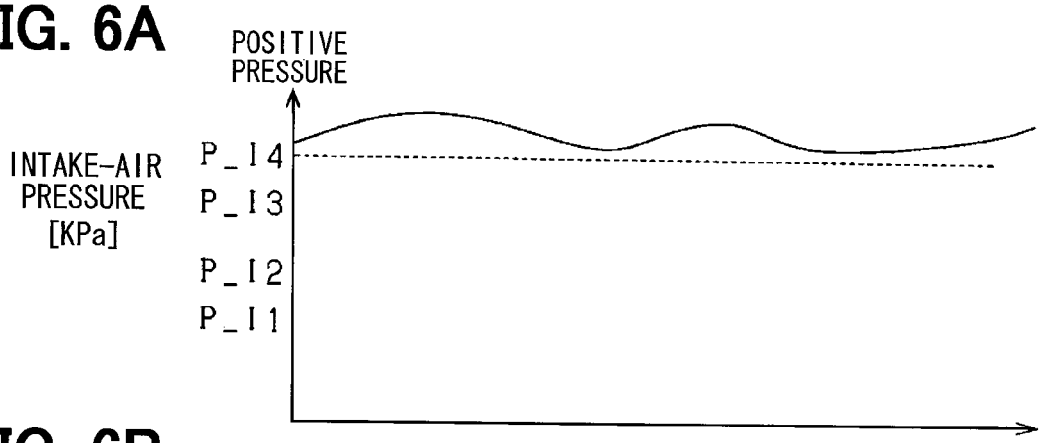
FIG. 6B
FIG. 6C
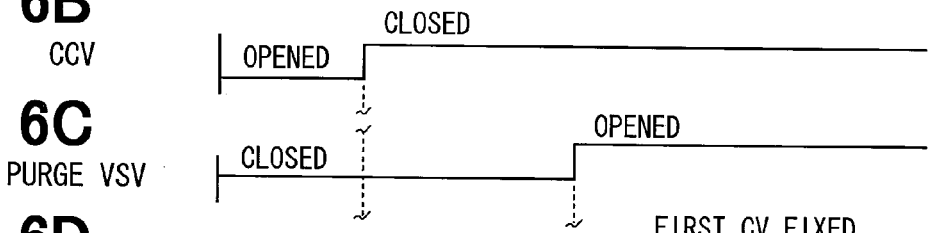
FIG. 6D
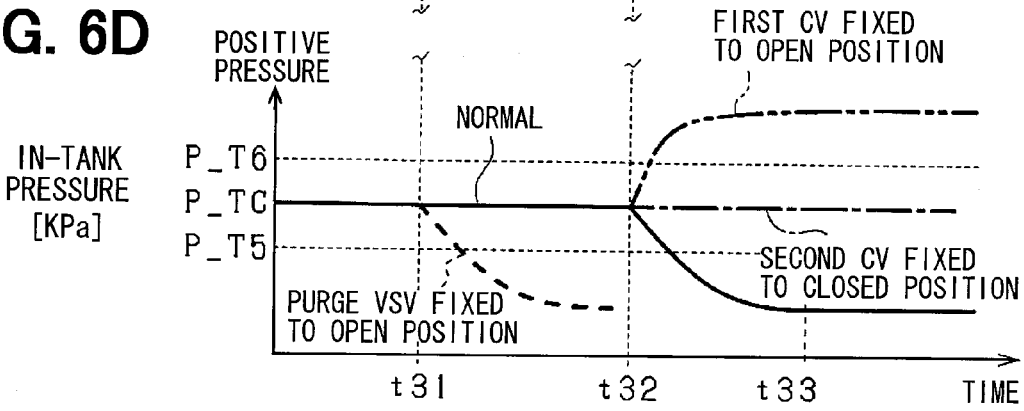

DIAGNOSIS FOR LEAK
DIAGNOSIS FOR AIR FLOW

S. POSITION
ELCM SWV
F. POSITION

ON
ELCM PUMP
OFF

OPENED
PURGE VSV
CLOSED

POSITIVE PRESSURE
SECOND CV OR FIRST CV FIXED TO OPEN POSITION
PRESSURE [KPa]
P_T7
Pref
NORMAL
Pleak
t40
t41
t42
t43
TIME

VAPORIZED-FUEL PROCESSING SYSTEM

CROSS-REFERENCE TO RELATED APPLICATION

This application is based on Japanese Patent Application No. 2012-021501 filed on Feb. 3, 2012, the disclosure of which is incorporated herein by reference.

FIELD OF TECHNOLOGY

The present disclosure relates to a vaporized-fuel processing system for an engine, more particularly, a vaporized-fuel processing system according to which vaporized fuel can be purged into an intake-air passage of the engine even during an engine operational period for supercharging intake air into the engine.

BACKGROUND

It is known in the art that vaporized fuel generated in a fuel tank is temporally absorbed in a canister and a purge control valve is opened depending on an operational condition of an engine, so that the vaporized fuel absorbed in the canister is supplied into an intake system of the engine together with fresh air because of negative pressure generated by the engine. As a result, the vaporized fuel is processed by combustion in the engine As disclosed in Japanese Patent Publication No. 2003-74423 (hereinafter, a prior art document No. 1), in the above vaporized-fuel processing system, an abnormal diagnosis is carried out for the purge control valve whether the purge control valve is normally operated or not. According to the above prior art document No. 1, a control amount for an air-fuel ratio is calculated during a process for increasing an amount for a purging operation and the purge control valve is determined as being fixed to its valve closed position, when such calculated control amount for the air-fuel ratio is lower than a predetermined value.

Recently, an engine having a supercharging device comes under a spotlight in view of a down-sizing of an engine. In case of such engine, it is not possible to supply vaporized fuel into an intake system of the engine by use of negative pressure generated by the engine. It is, therefore, anticipated that an opportunity for processing the vaporized fuel is reduced.

Such a vaporized-fuel processing system is developed, for example, as disclosed in the following prior art document No. 2:

"2011 MY OBD System Operation Summary for Gasoline Engines. [Online].Ford Motorcraft.Com. Retrieved from the Internet: <URL: http://www.motorcraftservice.com/vdirs/retail/default.asp?pagei d=diag_theory_retail&gutsid=diagsheet&kevin=rules>"

According to the above vaporized-fuel processing system, there are provided with two purging systems. According to one of the purging systems, the vaporized fuel is supplied into the intake system of the engine by use of the negative pressure via a first purge passage, during an engine operation in which a supercharging operation is not carried out for the intake air. According to the other one of the purging systems, the vaporized fuel is supplied into the intake system of the engine via a second purge passage, during an engine operation in which the intake air is supercharged.

More in detail, according to the above prior art document No. 2, the purge passage for connecting a canister and the intake system of the engine has the first and the second purge passages, wherein the first purge passage is connected to an intake-air passage at a downstream side of a throttle valve, while the second purge passage is connected to the intake-air passage at an upstream side of an intake-air compressor of the supercharging device. The purge control valve is provided in the purge passage, which is commonly used for the first and second purge passages. In addition, a first check valve, which is opened by the negative pressure in the intake-air passage, is provided in the first purge passage. An ejector, which is operated by supercharged intake air, and a second check valve, which is opened by operation of the ejector, are provided in the second purge passage.

According to such a system, the vaporized fuel absorbed in the canister is purged into the intake-air passage by the negative pressure of the engine, via the first purge passage, when the purge control valve is opened during the engine operation in which the supercharging operation is not carried out. On the other hand, the vaporized fuel absorbed in the canister is further purged into the intake-air passage of the engine by the operation of the ejector, via the second purge passage, when the purge control valve is opened during the engine operation in which the supercharging operation is carried out.

The above prior art document No. 2 further discloses that abnormal diagnosis is carried out for the check valves provided in the first and the second purge passages (more exactly, whether the first check valve in the first purge passage is fixed to its valve opened condition, and whether the second check valve in the second purge passage is fixed to its valve closed position), based on a changing ratio of a fuel pressure in the fuel tank in the condition that an air-communication valve for the canister is closed while the purge control valve is opened.

According to the above prior art document No. 2, however, it is only possible to diagnose specific abnormal conditions of the check valves provided in the purge passages. In other words, it is not possible to diagnose such abnormal conditions whether the first check valve provided in the first purge passage is fixed to its valve closed position or whether the second check valve provided in the second purge passage is fixed to its valve opened position. It is regulated by law for the vaporized-fuel processing system having two purge passages to carryout flow-check for the respective valves provided in each purge passage. Namely, it is necessary to identify which of the valves is not normally operated and whether such valve is fixed to its valve closed position or to its valve opened position.

SUMMARY OF THE DISCLOSURE

The present disclosure is made in view of the above point. It is an object of the present disclosure to provide a vaporized-fuel processing system having two purging systems, according to which it is possible to diagnose each of valves provided in purge passages whether it is not normally operated and whether it is not fixed to a valve closed or a valve opened position.

According to a feature of the present disclosure, a vaporized-fuel processing system is composed of;

an absorbing device for absorbing vaporized fuel generated in a fuel tank;

an air-communication valve provided in the absorbing device for cutting off supply of atmospheric air into the absorbing device when the air-communication valve is closed; and a purge control valve provided in a purge pipe which connects the absorbing device to an intake-air passage of an engine, the vaporized fuel of the absorbing device is purged into the intake-air passage when the purge control valve is opened.

In addition, a throttle valve is provided in the intake-air passage for controlling an amount of intake air to be supplied into the engine.

A supercharging device is provided in the intake-air passage at an upstream side of the throttle valve for supercharging the intake air.

A first and a second purge passage are branched out from the purge pipe at a downstream side of the purge control valve, wherein the first purge passage is connected to the intake-air passage at a downstream side of the throttle valve, and the second purge passage is connected to the intake-air passage at an upstream side of the supercharging device.

A first check valve is provided in the first purge passage, wherein the first check valve is opened by negative pressure generated in the intake-air passage at the downstream side of the throttle valve.

An ejector and a second check valve are provided in the second purge passage, wherein the ejector is operated by the intake air supercharged by the supercharging device and the second check valve is opened by an operation of the ejector.

In addition, a pressure sensor is provided for detecting an in-tank pressure, which corresponds to a pressure of a space including the fuel tank, the absorbing device, a connecting pipe between the fuel tank and the absorbing device.

A determination unit is provided for determining whether an upstream-side pressure of the throttle valve, which corresponds to a pressure of the intake air in the intake-air passage at the upstream side of the throttle valve, is at an atmospheric pressure, at a positive pressure with respect to the atmospheric pressure or at a negative pressure with respect to the atmospheric pressure.

The determination unit further determines whether a downstream-side pressure of the throttle valve, which corresponds to a pressure of the intake air in the intake-air passage at the downstream side of the throttle valve, is at the atmospheric pressure, at the positive pressure or at the negative pressure.

A diagnostic unit is provided for diagnosing abnormal conditions of the purge control valve, the first check valve and the second check valve, in order to identify which of the valves is not normally operated and whether such a valve is fixed to its valve opened position or to its valve closed position, wherein a diagnosing process of the diagnostic unit is carried out based on determination result of the determination unit and a change of the in-tank pressure detected by the pressure sensor, in a condition that the air-communication valve is closed and the purge control valve is opened.

According to the above feature, there are two purging systems being composed of the first and the second purge passages. In such a structure, a purging characteristic (for example, through which purge passage the vaporized fuel absorbed in the absorbing device is purged into the intake-air passage) differs from case to case depending on respective engine operating conditions, namely whether each of the downstream-side and the upstream-side pressure of the throttle valve is at the atmospheric pressure, at the positive pressure or at the negative pressure.

When any one of the valves provided in the purge pipe or purge passages is not normally operated, the change of the in-tank pressure (which is measured in the condition that the air-communication valve is closed but the purge control valve is opened) differs depending on respective abnormal conditions of each valve. The present inventors investigated relationship between the change of the in-tank pressure and the abnormal conditions of each valve and found out each abnormal condition of the valves, which is different from case to case depending the downstream-side pressure and the upstream-side pressure of the throttle valve.

According to the present disclosure, therefore, the change of the in-tank pressure (which is measured in the condition that the air-communication valve is closed but the purge control valve is opened during the engine operation) is used as one of parameters for identifying the abnormal conditions (fixed to the valve opened position or to the valve closed position) of the purge control valve, the first check valve and the second check valve. In other words, the abnormal diagnosis is carried out by taking into consideration whether each of the downstream-side and upstream-side pressure of the throttle valve is at the atmospheric pressure, at the positive pressure or at the negative pressure. According to the above features, it is possible to identify which of the valves is not normally operated and whether such a valve is fixed to the valve opened position or to the valve closed position. Accuracy of the abnormal diagnosis for the air flow of the vaporized-fuel processing system is thus increased.

According to another feature of the present disclosure, the determination unit determines which of operating conditions (among the following first to third operating conditions) the engine operation corresponds to, based on the respective upstream-side and downstream-side pressures;

- the first operating condition, when the upstream-side pressure of the throttle valve is at the atmospheric pressure and the downstream-side pressure of the throttle valve is at the negative pressure,
- the second operating condition, when the upstream-side pressure of the throttle valve is at the positive pressure and the downstream-side pressure of the throttle valve is at the negative pressure, and
- the third operating condition, when the upstream-side pressure of the throttle valve as well as the downstream-side pressure of the throttle valve is at the positive pressure.

The diagnostic unit detects the change of the in-tank pressure for each of the first, the second and the third operating condition, in the condition that the air-communication valve is closed and the purge control valve is opened, in order to diagnose the abnormal conditions of the respective valves based on detected change of the in-tank pressure.

The abnormal conditions, which can be identified based on the change of the in-tank pressure in the condition that the air-communication valve is closed while the purge control valve is opened, differ in each of the engine operating conditions (from the first to the third operating conditions). According to the present disclosure, the abnormal diagnosis is carried out for the three different engine operating conditions in the condition that the air-communication valve is closed while the purge control valve is opened, in order to increase a number of the abnormal conditions, which can be identified by the abnormal diagnosis (except for the abnormal condition in which the purge control valve is fixed to the valve opened position).

However, the abnormal condition for the purge control valve fixed to the valve opened position can be detected in the following way. In a case that the purge control valve is the normally-closed type valve (the valve is closed when no electric power is supplied), the in-tank pressure is detected in the condition that the air-communication valve is closed while the purge control valve is controlled to be maintained in its valve closed position (namely, no electric power is supplied to the purge control valve). When the purge control valve is fixed to the valve opened position, the in-tank pressure is decreased by the negative pressure of the downstream side of the throttle valve. Therefore, it is possible to determine that the purge control valve is fixed to the valve opened position. When the abnormal diagnosis for the purge control valve fixed to the valve opened position is combined to the abnormal diagnosis which is carried out in the condition that the air-communication valve is closed while the purge control valve is opened, all of the abnormal conditions (the valve fixed condition to the valve opened position and to the valve closed position for all of the valves) can be detected.

BRIEF DESCRIPTION OF THE DRAWINGS

The above and other objects, features and advantages of the present disclosure will become more apparent from the following detailed description made with reference to the accompanying drawings. In the drawings:

FIGS. 2A to 2D are time charts showing a process of abnormal diagnosis for air flow in an operating condition of lower negative pressure;

FIG. 3 is a schematic view showing air flow when a second check valve is fixed to a valve opened position;

FIGS. 4A to 4D are time charts showing a process of abnormal diagnosis for air flow in an operating condition of higher negative pressure;

FIG. 5 is a schematic view showing air flow when a first check valve is fixed to a valve closed position;

FIGS. 6A to 6D are time charts showing a process of abnormal diagnosis for air flow in a supercharge operating condition;

DETAILED DESCRIPTION OF THE EMBODIMENTS

Figure 1:
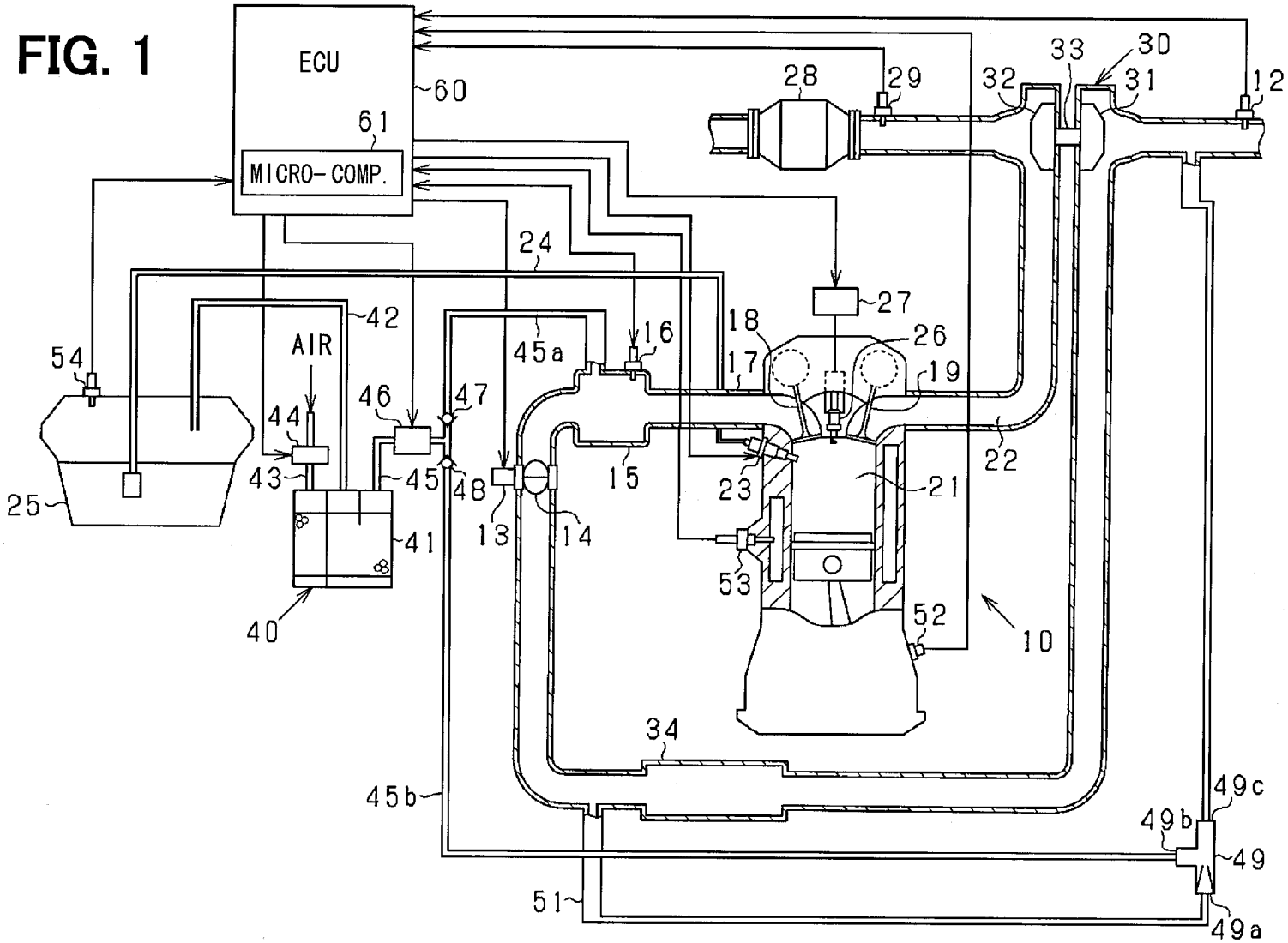
FIG. 1 is a schematic view showing an entire structure for an engine control system according to a first embodiment of the present disclosure.

The present disclosure will be explained hereinafter by way of multiple embodiments. The same reference numerals are used throughout the embodiments for designating the same or similar parts and/or portions between the embodiments so as to omit the repeated explanation.

(First Embodiment)

A first embodiment, to which the present disclosure is applied, will be explained with reference to the drawings. In the present embodiment, the present disclosure is applied to an engine control system for a multi-cylinder internal combustion engine (hereinafter, the engine) mounted in a vehicle. The engine is controlled by an electronic control unit (hereinafter, ECU).

In the engine 10 shown in FIG. 1, an air-flow meter 12 is provided in an intake-air passage 11 for detecting a flow amount of intake air. A throttle valve 14 (a flow-amount control device) is provided at a downstream side of the air-flow meter 12, wherein an opening degree of the throttle valve 14 is controlled by a throttle actuator 13 composed of, for example, an electric DC motor. The opening degree of the throttle valve 14 (a throttle opening degree) is detected by a sensor (not shown) provided in an inside of the throttle actuator 13. A surge tank 15 provided at a downstream side of the throttle valve 14. An intake-air pressure sensor 16 is provided at the surge tank 15 for detecting pressure of the intake air flowing through the intake-air passage 11 (that is, a downstream-side pressure of the throttle valve). An intake manifold 17 is connected to the surge tank 15 so as to supply the intake air into respective cylinders of the engine. The intake-air passage is connected to each of intake ports of the respective cylinders of the engine via the intake manifold 17.

An intake valve 18 and an exhaust valve 19 are respectively provided at the intake and exhaust ports of each cylinder of the engine 10. When the intake valve 18 is opened, the intake air in the surge tank 15 is supplied into a combustion chamber 21 of each cylinder. When the exhaust valve 19 is opened, exhaust gas after combustion is discharged into an exhaust passage 22.

A fuel injection valve 23 is provided at an upper portion of each cylinder of the engine 10, so as to directly inject fuel into the combustion chamber 21. The fuel injection valve 23 is connected to a fuel tank 25 via a fuel pipe 24, so that the fuel in the fuel tank 25 is supplied to the fuel injection valve 23.

A spark plug 26 is provided in a cylinder head of the engine 10 for the respective cylinders. A high voltage is applied to the spark plug 26 at a desired ignition timing by an ignition device 27, which is composed of an ignition coil and so on. A spark is discharged between opposing electrodes of the spark plug 26 when the high voltage is supplied thereto, so that air-fuel mixture is ignited and combusted in the combustion chamber 21.

A catalyst 28 is provided in the exhaust passage 22 of the engine 10 so as to purify harmful components, such as, CO, HC, NOx or the like contained in the exhaust gas. In the present embodiment, a three-way catalyst is used as the catalyst 28. An air-fuel ratio sensor 29 is provided in the exhaust passage 22 at an upstream side of the catalyst 28 in order to detect air-fuel ratio of the air-fuel mixture (oxygen concentration in the exhaust gas).

A turbocharger 30 is provided, as a supercharging device, between the intake-air passage 11 and the exhaust gas passage 22. The turbocharger 30 is composed of an intake-air compressor 31 located in the intake-air passage 11 at an upstream side of the throttle valve 14, an exhaust-gas turbine 32 located in the exhaust gas passage 22 at the upstream side of the catalyst 28, and a rotational shaft 33 for connecting the intake-air compressor 31 and the exhaust-gas turbine 32 to each other. When the exhaust-gas turbine 32 is rotated by the exhaust gas flowing through the exhaust gas passage 22, the intake-air compressor 31 is driven to rotate by the exhaust-gas turbine 32 so that the intake air is compressed (supercharged) by centrifugal force generated by the rotation of the intake-air compressor 31.

An intercooler 34 is provided in the intake-air passage 11 at the downstream side of the intake-air compressor 31 so as to cool the supercharged intake air, in order to prevent decrease of compression efficiency. In the present embodiment, it is possible to control supercharging pressure of the intake air by adjusting an opening degree of a variable vane (not shown).

The engine control system of the present embodiment has a vaporized-fuel processing apparatus 40, according to which combustion treatment by the engine 10 is carried out for vaporized fuel generated in the inside of the fuel tank 25. More in detail, the vaporized-fuel processing apparatus 40 has a canister 41, in which absorption material (such as, activated carbon or the like) is filled. The canister 41 is connected to the fuel tank 25 via a connecting pipe 42, so that the vaporized-fuel generated in the fuel tank 25 is absorbed in the canister 41. The canister 41 has an air-communication pipe 43 through which the canister 41 is communicated to the air. In addition, the canister 41 further has an air-communication valve 44, which is provided in the air-communication pipe 43 for opening or closing an air passage formed in the air-communication pipe 43. By on-off control of the air passage, the air-communication valve 44 controls supply of fresh air to be introduced into the canister 41. In the present embodiment, the air-communication valve 44 is an electromagnetic valve of a normally-opened type, so that the air passage is opened when no electric power is supplied, while the air passage is closed when the electric power is supplied to the air-communication valve 44.

A purge pipe 45 is further connected to the canister 41, so that the canister 41 is connected to the intake-air passage 11. A purge control valve 46 is provided in the purge pipe 45. The purge control valve 46 is composed of an electromagnetic valve of a normally closed type, so that the purge pipe 45 is closed when no electric power is supplied, while the purge pipe 45 is opened when the electric power is supplied to the purge control valve 46. When a power-supply duty ratio is changed, an opening degree of the purge control valve 46 is changed.

The vaporized-fuel processing apparatus 40 of the present embodiment has two purge systems, according to which the vaporized fuel is purged to the intake-air passage 11 via a first purge passage 45*a* when the intake air is not supercharged by the turbocharger 30 (hereinafter, referred to as a non-supercharging operation period) on one hand, while the vaporized fuel is purged to the intake-air passage 11 via a second purge passage 45*b* (different from the first purge passage 45*a*) when the intake air is supercharged by the turbocharger 30 (hereinafter, referred to as a supercharging operation period). More in detail, the purge pipe 45 is bifurcated at a downstream side of the purge control valve 46. The first purge passage 45*a* is connected between the purge pipe 45 at the downstream side of the purge control valve 46 and the intake-air passage 11 at the downstream side of the throttle valve 14. The second purge passage 45*b* is connected between the purge pipe 45 at the downstream side of the purge control valve 46 and the intake-air passage 11 at the upstream side of the intake-air compressor 31.

A first check valve 47 is provided in the first purge passage 45*a*, wherein the first check valve 47 is opened by negative pressure of the intake air in the intake-air passage 11 at the downstream side of the throttle valve 14. A reversed flow of the intake air from the intake-air passage 11 to the purge pipe 45 and to the second purge passage 45*b* is prevented by the first check valve 47.

An ejector 49, which is operated by supercharged intake air produced by the intake-air compressor 31, as well as a second check valve 48, which is opened by an operation of the ejector 49, is provided in the second purge passage 45*b*. A reversed flow of the intake air from the intake-air passage 11 to the purge pipe 45 is prevented by the second check valve 48.

The ejector 49 is a fluid pump operated by the supercharged intake air. More in detail, the ejector 49 has a first inlet port 49*a*, a second inlet port 49*b* and a discharge port 49*c*. The first inlet port 49*a* is connected to an intermediate portion of the intake-air passage 11 between the intake-air compressor 31 and the throttle valve 14 via a communication pipe 51. The second inlet port 49*b* is connected to the second check valve 48. The discharge port 49*c* is connected to the intake-air passage 11 at the upstream side of the intake-air compressor 31. A nozzle portion is formed in the inside of the ejector 49. When the supercharged intake air, that is, high-pressure fluid, is supplied into the ejector 49 via the first inlet port 49*a*, the supercharged intake air is depressurized by the nozzle portion and purge gas is sucked into the ejector 49 through the second inlet port 49*b*. The purge gas sucked from the second inlet port 49*b* is discharged from the discharge port 49*c* into the intake-air passage 11 at the upstream side of the intake-air compressor 31.

The engine control system of the present embodiment is further composed of a crank angle sensor 52 for outputting a crank angle signal for predetermined crank angles of the engine 10, a water temperature sensor 53 for detecting temperature of engine cooling water, an in-tank pressure sensor 54 provided in the fuel tank 25 for detecting pressure of fuel in the fuel tank 25, and so on.

An electronic control unit (ECU) 60 is composed of a micro-computer 61 having well-known CPU, ROM, RAM and so on. The ECU 60 carries out various kinds of programs stored in the ROM so as to perform various kinds of controls for the engine 10. More in detail, the micro-computer 61 receives various kinds of detection signals from the above mentioned various kinds of sensors in order to control the fuel injection valves 23, the ignition device 27 and so on based on such inputted detection signals.

In addition, the micro-computer 61 controls an on-off operation of the purge control valve 46 so as to carryout combustion treatment for the vaporized fuel absorbed in the canister 41. According to the present embodiment, when a predetermined purge condition is satisfied, the purge control valve 46 is opened while an opened condition of the air-communication valve 44 is maintained, in order to discharge the vaporized fuel absorbed in the canister 41 into the intake-air passage 11. For example, in the present embodiment, the predetermined purge condition is satisfied, when at least one of the following conditions is satisfied;

- when the detection value of the in-tank pressure sensor 54 (that is, the fuel pressure in the fuel tank 25) becomes higher than a predetermined threshold value,
- when a predetermined time has passed over since a previous purge control has been carried out, or
- when the temperature of the engine cooling water becomes higher than a predetermined value.

The vaporized fuel generated in the fuel tank 25 is discharged into the intake-air passage 11 during an engine operation, in the following manners depending on the supercharging condition for the intake air.

At first, in the non-supercharging operation period, the intake-air pressure at the downstream side of the throttle valve 14 (the downstream-side pressure of the throttle valve) becomes lower than the atmospheric pressure. Namely, the downstream-side pressure of the throttle valve becomes negative pressure. A purging operation is carried out through the first purge passage 45*a* by use of the negative pressure of the intake air.

More in detail, the purge control valve 46 is opened, when the predetermined purge condition is satisfied in the non-supercharging operation period. Then, a first air flow passage is formed by pressure difference between the atmospheric pressure and the downstream-side pressure of the throttle valve, so that the air flows in the first air flow passage via "the canister 41", "the first purge passage 45*a*" and "the downstream side of the throttle valve 14". The vaporized fuel absorbed in the canister 41 is discharged into the intake-air passage 11 at the downstream side of the throttle valve 14, together with fresh air. The vaporized fuel is further supplied into the combustion chamber 21 and the combustion treatment is carried out for the vaporized fuel by the engine 10 during its combustion stroke.

In the non-supercharging operation period, since the intake-air pressure at the upstream side of the throttle valve 14 (hereinafter, the upstream-side pressure of the throttle valve) is almost equal to the atmospheric pressure, the ejector 49 does not work as the fluid pump. In other words, in the non-supercharging operation period, a purging operation via the second purge passage 45*b* is not carried out. The upstream-side pressure of the throttle valve corresponds to the intake-air pressure in the intake-air passage 11 between the throttle valve 14 and the intake-air compressor 31.

On the other hand, in the supercharging operation period, the downstream-side pressure of the throttle valve becomes higher than the atmospheric pressure. Namely, the downstream-side pressure of the throttle valve is positive pressure. Therefore, the purging operation is not carried out through the first purge passage 45*a*. However, since the ejector 49 works as the fluid pump by the supercharged intake air (the high-pressure fluid), a purging operation is carried out through the second purge passage 45*b*.

More in detail, the purge control valve 46 is opened, when the predetermined purge condition is satisfied in the supercharging operation period. Then, a second air flow passage is formed by the operation of the ejector 49, so that the air flows in the second air flow passage via "the canister 41", "the second purge passage 45*b*" and "the upstream side of the throttle valve 14". In a similar manner for the non-supercharging operation period, the vaporized fuel absorbed in the canister 41 is discharged into the intake-air passage 11 at the upstream side of the intake-air compressor 31, together with fresh air. The vaporized fuel is further supplied into the combustion chamber 21 and the combustion treatment is carried out by the engine 10 during its combustion stroke.

It is legislated to carry out a flow check in each of the purge passages, in a case that the vaporized-fuel processing apparatus has two purging systems (two purging passages). Therefore, the micro-computer 61 of the ECU 60 carries out abnormal diagnosis for opening and/or closing operations of the purge control valve 46, the first check valve 47 and the second check valve 48.

In the present embodiment for the engine control system, attention is focused on the following points:

(1) in a condition that the electric power is respectively supplied to the air-communication valve 44 and the purge control valve 46 so as to close the air-communication valve 44 but to open the purge control valve 46 during the engine operation, a change of the in-tank pressure in a case of an abnormal operation of the respective valves provided in the purge passages is different from that of the in-tank pressure in a case of a normal operation of the respective valves provided in the purge passages; and (2) a relationship between the change of the in-tank pressure and a condition of the abnormal operation differs from case to case depending on an operational condition of the engine 10.

Therefore, according to the present embodiment, the ECU 60 detects the change of the in-tank pressure in the condition that the air-communication valve 44 is closed and the purge control valve 46 is opened. Then, the ECU 60 identifies the condition of the abnormal operation for the purge control valve 46, the first check valve 47 and the second check valve 48, based on the detected change of the in-tank pressure and the current operational condition of the engine 10.

A characteristic for a purging amount or a characteristic for a purging operation, for example, through which of the purge passages (45*a*, 45*b*) the vaporized fuel absorbed in the canister 41 is purged into the intake-air passage 11 or the like, depends on the operational condition of the engine.

For example, in a first operational condition, the upstream-side pressure of the throttle valve is the atmospheric pressure, while the downstream-side pressure of the throttle valve is negative pressure. In the above first operational condition (which is also referred to as an operational condition in a lower negative pressure region), the purging operation is carried out through the first purge passage 45*a* by use of the negative pressure of the intake air at the downstream side of the throttle valve 14, but the purging operation is not carried out through the second purge passage 45*b*.

In a second operational condition, the upstream-side pressure of the throttle valve is positive pressure, while the downstream-side pressure of the throttle valve is negative pressure. In the above second operational condition (which is also referred to as an operational condition in a higher negative pressure region), the purging operation is preferentially carried out through the first purge passage 45*a* by use of the negative pressure of the intake air at the downstream side of the throttle valve 14, like the first operational condition. Since, in the second operational condition, the upstream-side pressure of the throttle valve is positive pressure, the ejector 49 is likely to operate so as to carry out the purging operation through the second purge passage 45*b*.

In a third operational condition, both of the upstream-side pressure and the downstream-side pressure of the throttle valve is positive pressure. In the above third operational condition (which is also referred to as an operational condition in a supercharging region), the purging operation is carried out through the second purge passage 45*b*, but the purging operation is not carried out through the first purge passage 45*a*.

As above, the characteristic for the purging operation differs from the condition to the condition, namely whether each of the upstream-side pressure and the downstream-side pressure of the throttle valve is the negative pressure or the positive pressure with respect to the atmospheric pressure or whether the upstream-side pressure of the throttle valve is the atmospheric pressure or not.

A process of the present embodiment for the abnormal diagnosis of the air flow will be explained. Abnormal conditions can be identified based on a change of the in-tank pressure, in the condition that the air-communication valve 44 is closed but the purge control valve 46 is opened during the engine operation. The abnormal conditions will be explained for each case of multiple purging operations.

(In all Operating Region)

When the abnormal diagnosis is carried out in various kinds of operating conditions of the engine 10, it is desirable to give a diagnosis at first whether the purge control valve 46 is fixed to a valve opened position and to confirm that the purge control valve 46 is not fixed to the valve opened position. The diagnosis for the fixed condition of the purge control valve 46 in the valve opened position is performed based on the change of the in-tank pressure when the air-communication valve 44 is controlled to change from its valve opened condition to a valve closed condition (in this diagnosis, the electric power is not supplied to the purge control valve 46).

In a case that the purge control valve 46 is not fixed to the valve opened position, the valve closed condition of the purge control valve 46 is maintained at a time point "t11", as shown in FIG. 2C. As shown in FIG. 2B, the air-communication valve 44 (indicated by CCV in FIG. 2B) is changed from the valve opened position to the valve closed position at the time point "t11". As indicated by a solid line in FIG. 2D, the in-tank pressure is not changed even after the air-communication valve 44 is closed at the time point "t11".

On the other hand, in a case that the purge control valve 46 is fixed to the valve opened position, the vaporized fuel absorbed in the canister 41 is purged into the intake-air passage 11 so that air suction operation occurs in the fuel tank 25. As a result, the in-tank pressure is decreased to a value almost equal to the intake-air pressure (the downstream-side pressure of the throttle valve), as indicated by a dotted line in FIG. 2D. Accordingly, it is possible to identify the abnormal condition that the purge control valve 46 (indicated by Purge VSV in FIG. 2C) is fixed to its valve opened position.

(In the Operating Region of Lower Negative Pressure)

An operating condition of the engine 10 of a low rotational speed and a low load, in which the upstream-side pressure of the throttle valve is the atmospheric pressure but the downstream-side pressure of the throttle valve is the negative pressure, corresponds to the engine operating region of the lower negative pressure. In such operating region of the lower negative pressure, the vaporized fuel absorbed in the canister 41 is purged into the intake-air passage 11 through the first purge passage 45*a* when the purge control valve 46 is opened, in a condition that all of the purge control valve 46, the first check valve 47 and the second check valve 48 are normally operated (that is, in a normal condition). As shown in FIG. 2C, the purge control valve 46 (the purge VSV) is opened at a time point "t12". Since the air suction operation occurs in the fuel tank 25 because of the purging operation, the in-tank pressure is decreased to a value lower than an initial in-tank pressure "P-TA" (that is, an in-tank pressure before a diagnosing operation) after the time point "t12", as indicated by a solid line in FIG. 2D. The initial in-tank pressure "P-TA" corresponds to an in-tank pressure in a condition that the air-communication valve 44 is opened and the purge control valve 46 is closed before the purging operation.

(1) Fixed Condition of the Second Check Valve 48 in the Valve Opened Position:

In the operating region of the lower negative pressure, the upstream-side pressure of the throttle valve is almost equal to the atmospheric pressure. Therefore, there exists no substantial air flow in the second purge passage 45*b*, in the condition that all of the purge control valve 46, the first check valve 47 and the second check valve 48 are normally operated.

However, in a case that the second check valve 48 is fixed to its valve opened position, there occurs an air flow in the second purge passage 45*b* by the negative pressure of the intake air at the downstream side of the throttle valve 14, according to which the fresh air flows in a reversed direction in the second purge passage 45*b* from the upstream side of the intake-air compressor 31 into the intake-air passage 11 at the downstream side of the throttle valve 14. More exactly, as shown in FIG. 3 (as indicated by arrows of solid lines in FIG. 3), the fresh air flows through "the upstream side of the intake-air compressor 31", "the second purge passage 45*b*", "the first purge passage 45*a*" and "the downstream side of the throttle valve 14". Because of this air flow, the purging operation for the vaporized fuel absorbed in the canister 41 is suppressed. In other words, as indicated by a one-dot-chain line in FIG. 2D, the in-tank pressure is decreased but a decreasing amount is smaller than that (indicated by the solid line in FIG. 2D) in the case of the normal operation.

In the present embodiment, the above phenomenon is taken into consideration. Namely, in the present embodiment, the second check valve 48 is determined as being fixed to its valve opened position, when the in-tank pressure at a time point "t13" is between a first threshold value "P-T1" and a second threshold value "P-T2", as shown in FIG. 2D. More exactly, the in-tank pressure is detected at the time point "T13" after a predetermined time period from the time point "T12", in a condition that the air-communication valve 44 (CCV) is maintained in its closed condition while the purge control valve 46 (the purge VSV) is changed from the closed condition to the opened condition, as shown in FIGS. 2B and 2C. The first threshold value "P-T1" is preset at a value lower than the initial pressure "P-TA", while the second threshold value "P-T2" is preset at a value between the first threshold value "P-T1" and the initial pressure "P-TA" (namely, higher than "P-T1" but lower than "P-TA").

(2) Fixed Condition of the Purge Control Valve 46 in the Valve Closed Position or the Fixed Condition of the First Check Valve 47 in the Valve Closed Position:

When the purge control valve 46 and/or the first check valve 47 is fixed to its valve closed position, the vaporized fuel generated in the fuel tank 25 cannot flow into the canister 41. Therefore, even when the electric power is supplied to the purge control valve 46 in order to open the purge control valve 46, the in-tank pressure does not change, as indicated by a two-dot-chain line in FIG. 2D. According to the present embodiment, the purge control valve 46 and/or the first check valve 47 is determined as being fixed to its valve closed position, when the in-tank pressure at a time point (for example, at the time point "t13") is higher than the second threshold value "P-T2". In other words, the in-tank pressure is detected at the time point (for example, at the time point "T13") after a predetermined time period from the time point "T12", in the condition that the electric power is respectively supplied to the air-communication valve 44 (CCV) and the purge control valve 46 (the purge VSV) so as to close the air-communication valve 44 (CCV) but to open the purge control valve 46 (the purge VSV). The detected in-tank pressure is then compared with the second threshold value "P-T2", in order to determine whether the purge control valve 46 and the first check valve 47 are normally operated or not.

(In the Operating Region of Higher Negative Pressure)

An operating condition of the engine 10 of a high rotational speed and a high load, in which the upstream-side pressure of the throttle valve is the positive pressure due to the supercharging operation of the turbocharger 30 but the downstream-side pressure of the throttle valve is the negative pressure, corresponds to the engine operating region of the higher negative pressure. In such operating region of the higher negative pressure, the vaporized fuel absorbed in the canister 41 is purged into the intake-air passage 11 through the first purge passage 45*a* when the purge control valve 46 is opened, in the condition that all of the purge control valve 46, the first check valve 47 and the second check valve 48 are normally operated. As shown in FIG. 4C, the purge control valve 46 (the purge VSV) is opened at a time point "t22". Since the air suction operation occurs in the fuel tank 25 because of the purging operation, the in-tank pressure is decreased to a value lower than an initial in-tank pressure "P-TB" after the time point "t22", as indicated by a solid line in FIG. 4D. The initial in-tank pressure "P-TB" corresponds to an in-tank pressure before the diagnosing operation.

(3) Fixed Condition of the First Check Valve 47 in the Valve Closed Position:

When the first check valve 47 is fixed to its valve closed position, the purging operation cannot be carried out through the first purge passage 45*a*. On the other hand, since the upstream-side pressure of the throttle valve is the positive pressure, the ejector 49 is operated. Then, the vaporized fuel absorbed in the canister 41 is purged into the intake-air passage 11 through the second purge passage 45*b*, as indicated by arrows of solid lines in FIG. 5. In this operation, the upstream-side pressure of the throttle valve is not so high as that of a case in the operating region of the supercharging operation. Therefore, a purging amount is smaller than that of the normal operation, in which the first check valve 47 as well as other valves is normally operated. In this operation, therefore, as indicated by a one-dot-chain line in FIG. 4D, the in-tank pressure is decreased but a decreasing amount is smaller than that of the normal operation.

In the present embodiment, the above phenomenon is taken into consideration. Namely, in the present embodiment, the first check valve 47 is determined as being fixed to its valve closed position, when the in-tank pressure at a time point "t23" is between a third threshold value "P-T3" and a fourth threshold value "P-T4", as shown in FIG. 4D. More exactly, the in-tank pressure is detected at the time point "T23" after a predetermined time period from the time point "T22", in a condition that the air-communication valve 44 (CCV) is maintained in its closed condition while the purge control valve 46 (the purge VSV) is changed from the closed condition to the opened condition, as shown in FIGS. 4B and 4C. The third threshold value "P-T3" is preset at a value lower than the initial pressure "P-TB", while the fourth threshold value "P-T4" is preset at a value between the third threshold value "P-T3" and the initial pressure "P-TB" (namely, higher than "P-T3" but lower than "P-TB").

(4) Fixed Condition of the Purge Control Valve 46 in the Valve Closed Position:

When the purge control valve 46 is fixed to its valve closed position, the vaporized fuel absorbed in the canister 41 cannot be purged into the intake-air passage 11.

Therefore, even when the electric power is supplied to the purge control valve 46 in order to open the purge control valve 46, the in-tank pressure does not change, as indicated by a two-dot-chain line in FIG. 4D. According to the present embodiment, the purge control valve 46 is determined as being fixed to its valve closed position, when the in-tank pressure at a time point (for example, at the time point "t23") is higher than the fourth threshold value "P-T4". In other words, the in-tank pressure is detected at the time point (for example, at the time point "T23") after a predetermined time period from the time point "T22", in the condition that the electric power is respectively supplied to the air-communication valve 44 (CCV) and the purge control valve 46 so as to close the air-communication valve 44 (CCV) but to open the purge control valve 46 (the purge VSV). The detected in-tank pressure is then compared with the fourth threshold value "P-T4" in order to determine whether the purge control valve 46 is normally operated or not.

(In the Operating Region of the Supercharging Operation)

When the vehicle is accelerated, running at a high speed or running on an uphill slope, the turbocharger 30 is operated so as to increase the pressure of the supercharged intake-air. Then, both of the upstream-side pressure of the throttle valve and the downstream-side pressure of the throttle valve become the positive pressure. In such an operating region of the supercharging operation, the vaporized fuel absorbed in the canister 41 is purged into the intake-air passage 11 through the second purge passage 45*b* when the purge control valve 46 is opened, in the normal operation, in which all of the purge control valve 46, the first check valve 47 and the second check valve 48 are normally operated. As shown in FIG. 6C, the purge control valve 46 (the purge VSV) is opened at a time point "t32". The in-tank pressure is decreased to a value lower than an initial in-tank pressure "P-TC" (that is, an in-tank pressure before a diagnosing operation) after the time point "t32", as indicated by a solid line in FIG. 6D.

(5) Fixed Condition of the Second Check Valve 48 in the Valve Closed Position:

When the second check valve 48 is fixed to its valve closed position, the vaporized fuel absorbed in the canister 41 is not purged into the intake-air passage 11 through the second purge passage 45*b*. Therefore, as indicated by a one-dot-chain line in FIG. 6D, the in-tank pressure does not change even when the electric power is supplied to the purge control valve 46 in order to open it.

In the present embodiment, the above phenomenon is taken into consideration. Namely, in the present embodiment, the second check valve 48 is determined as being fixed to its valve closed position, when the in-tank pressure at a time point "t33" is between a fifth threshold value "P-T5" and a sixth threshold value "P-T6", as shown in FIG. 6D. More exactly, the in-tank pressure is detected at the time point "T33" after a predetermined time period from the time point "T32", in a condition that the air-communication valve 44 (CCV) is maintained in its closed condition while the purge control valve 46 (the purge VSV) is changed from the closed condition to the opened condition, as shown in FIGS. 6B and 6C. The fifth threshold value "P-T5" is preset at a value lower than the initial pressure "P-TC", while the sixth threshold value "P-T6" is preset at a value higher than the initial pressure "P-TC". Then, the detected in-tank pressure is compared with the fifth and sixth threshold values "P-T5" and "P-T6" in order to determine whether the second check valve 48 is normally operated or not.

(6) Fixed Condition of the First Check Valve 47 in the Valve Opened Position:

When the first check valve 47 is fixed to its valve opened position, the intake air flows from the downstream side of the throttle valve 14 into the fuel tank 25 through the first purge passage 45*a*, when the purge control valve 46 is opened. As a result, the in-tank pressure is increased, as indicated by a two-dot-chain line in FIG. 6D. In the present embodiment, the above phenomenon is taken into consideration. Namely, in the present embodiment, the first check valve 47 is determined as being fixed to its valve opened position, when the in-tank pressure at a time point (for example, at the time point "t33") is higher than the sixth threshold value "P-T6". In other words, the in-tank pressure is detected at the time point (for example, at the time point "T33") after the predetermined time period from the time point "T32", in the condition that the electric power is respectively supplied to the air-communication valve 44 (CCV) and the purge control valve 46 (the purge VSV) so as to close the air-communication valve 44 (CCV) but to open the purge control valve 46 (the purge VSV). The detected in-tank pressure is then compared with the sixth threshold value "P-T6", in order to determine whether the first check valve 47 is normally operated or not.

The process for the abnormal diagnosis of the air flow for the vaporized-fuel processing apparatus 40 will be further explained by use of flow-charts with reference to FIGS. 7 to 10.

Figure 7:
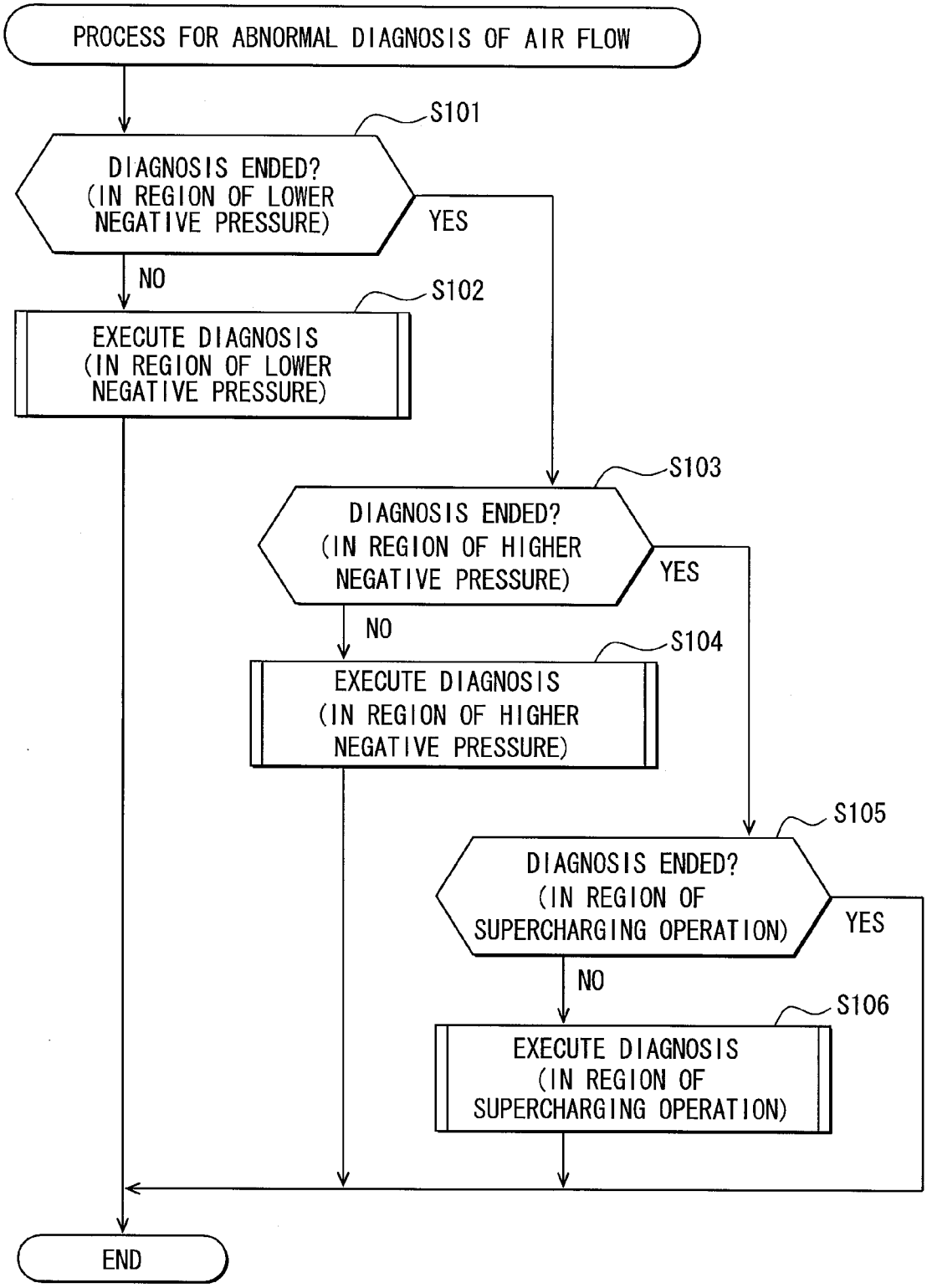
FIG. 7 is a flow-chart showing a main routine for the process of the abnormal diagnosis for the air flow.

FIG. 7 shows a main routine for the process of the abnormal diagnosis for the vaporized-fuel processing apparatus 40 of the present embodiment. As explained above, the abnormal diagnosis is carried out based on the change of the in-tank pressure, when the electric power is respectively supplied to the air-communication valve 44 and the purge control valve 46 so as to close the air-communication valve 44 but to open the purge control valve 46. In the present embodiment, the abnormal diagnosis is sequentially carried out in an order of a first operating condition, a second operating condition and a third operating condition. In addition, the result of the abnormal diagnosis, which has been done in the previous operating condition, is taken into consideration for the following abnormal diagnosis, in order to identify the respective abnormal conditions, namely which valve (among the purge control valve 46, the first check valve 47 and the second check valve 48) is not normally operated and how such valve is not normally operated (i.e. whether the valve is fixed to the valve opened position or to the valve closed position). The process for the abnormal diagnosis is periodically carried out by the micro-computer 61 of the ECU 60 at predetermined cycles.

In FIG. 7, the ECU 60 determines at a step S101 whether the process for the abnormal diagnosis has ended or not for the first operating condition (that is, the operating condition in the operating region of the lower negative pressure). At the step S101, the ECU 60 refers to a first determination-end flag, which indicates that the process for the abnormal diagnosis has ended for the first operating condition (the operating condition in the region of the lower negative pressure). When the first determination-end flag is ON, the ECU 60 determines that the process for the abnormal diagnosis has ended. When the process for the abnormal diagnosis has not yet ended for the first operating condition, the diagnosis process of FIG. 7 goes to a step S102, in order to carry out the process for the abnormal diagnosis for the operating condition in the region of the lower negative pressure (shown in FIG. 8).

When the diagnosis in the operating region of the lower negative pressure has ended (YES at the step S101), the diagnosis process goes to a step S103 so as to determine whether the process for the abnormal diagnosis has ended or not for the second operating condition (that is, the operating condition in the operating region of the higher negative pressure). At the step S103, the ECU 60 refers to a second determination-end flag, which indicates that the process for the abnormal diagnosis has ended for the second operating condition (the operating condition in the region of the higher negative pressure). When the second determination-end flag is ON, the ECU 60 determines that the process for the abnormal diagnosis has ended for the second operating condition. When the process for the abnormal diagnosis has not yet ended for the second operating condition (NO at the step S103), the diagnosis process goes to a step S104, in order to carry out the process for the abnormal diagnosis for the operating condition in the region of the higher negative pressure (shown in FIG. 9).

When the diagnosis in the operating region of the higher negative pressure has ended (YES at the step S103), the diagnosis process goes to a step S105 so as to determine whether the process for the abnormal diagnosis has ended or not for the third operating condition (that is, the operating condition in the operating region of the supercharging operation). At the step S105, the ECU 60 refers to a third determination-end flag, which indicates that the process for the abnormal diagnosis has ended for the third operating condition (the operating condition in the region of the supercharging operation). When the third determination-end flag is ON, the ECU 60 determines that the process for the abnormal diagnosis has ended for the third operating condition. When the process for the abnormal diagnosis has not yet ended for the third operating condition (NO at the step S105), the diagnosis process goes to a step S106, in order to carry out the process for the abnormal diagnosis for the operating condition in the region of the supercharging operation (shown in FIG. 10).

According to the present embodiment, when an ignition switch (an engine starting switch) of the engine 10 is turned off, the first determination-end flag, the second determination-end flag and the third determination-flag are turned off. As a result, during each engine operation from its start to its stop, the process of the abnormal diagnosis for the vaporized-fuel processing apparatus 40 is carried out one time. An order for the processes of the abnormal diagnosis for the respective operating conditions should not be limited to the above-explained order. The process of the abnormal diagnosis may be carried out for a predetermined interval (a predetermined traveling distance). In addition, the process of the abnormal diagnosis may be carried out by several times during each engine operation from the start to the stop.

The process for the abnormal diagnosis in first operating condition (the operating condition in the operating region of the lower negative pressure) will be explained with reference to FIG. 8. In a flowchart shown in FIG. 8, the ECU 60 determines at a step S200 whether a first standby flag F1 is turned OFF or not, and at a step S201 whether a second standby flag F2 is turned OFF or not.

The first standby flag F1 indicates that the ECU is in a condition for waiting a determination, which is made by the ECU whether a predetermined time has passed over since the air-communication valve 44 is closed in the diagnosis for the purge control valve 46 fixed to its valve opened position.

The second standby flag F2 indicates that the ECU is in a condition for waiting a determination, which is made by the ECU whether a predetermined time has passed over since the air-communication valve 44 is closed after the diagnosis for the purge control valve 46 fixed to its valve opened position.

When both of the first and second standby flags F1 and F2 are turned OFF, the diagnosis process goes to a step S202. At the step S202, the supply of the electric power to the air-communication valve 44 (CCV) and the purge control valve 46 (the purge VSV) is cut off, so that the air-communication valve 44 (CCV) is opened, while the purge control valve 46 (the purge VSV) is closed. At a step S203, the ECU determines whether the diagnosis for the purge control valve 46 (the purge VSV) fixed to the valve opened position has been carried out or not. At the step S203, the ECU refers to a determination-end flag for the purge VSV fixed to the valve opened position. When the determination-end flag for the purge VSV is turned ON, the ECU determines that the diagnosis for the purge control valve 46 (the purge VSV) fixed to the valve opened position has been carried out. On the other hand, when the determination-end flag for the purge control valve 46 (the purge VSV) is turned OFF, the ECU determines that the diagnosis for the purge control valve 46 (the purge VSV) fixed to the valve opened position has not yet been carried out.

When YES at the step S203, the diagnosis process goes to a step S204. At the step S204, the electric power is supplied to the air-communication valve 44 (CCV) so that the air-communication valve 44 (CCV) is closed (corresponding to the time point "t11" in FIG. 2B). The first standby flag F1 is turned ON. At a step S205, the ECU 60 determines whether the predetermined time has passed over since the air-communication valve 44 (CCV) is closed. The predetermined time is preset at such a time, during which the in-tank pressure does not reach a withstand pressure of the fuel tank 25 after the air-communication valve 44 (CCV) is closed.

When YES at the step S205, the diagnosis process goes to a step S206. The ECU 60 determines at the step S206 whether the in-tank pressure "Ptk" detected by the in-tank pressure sensor 54 is lower than the first threshold value "P-T1" (FIG. 2D). When the in-tank pressure "Ptk" is higher than the first threshold value "P-T1" (NO at the step S206), the determination-end flag for the purge VSV fixed to the valve opened position is turned ON and the first standby flag F1 is turned OFF. Then the diagnosis process goes to END.

On the other hand, when YES at the step S206, namely when the in-tank pressure "Ptk" is lower than the first threshold value "P-T1", the diagnosis process goes to a step S207. At the step S207, the ECU determines that there exists an abnormal situation for the purge control valve 46 (the purge VSV), in which the purge control valve 46 is fixed to its valve opened position. In addition, the determination-end flag for the purge VSV fixed to the valve opened position is turned ON, while the first standby flag F1 is turned OFF. Then, the diagnosis process is terminated.

When the diagnosis for the purge control valve 46 (the purge VSV) fixed to the valve opened position has ended, the determination of the step S203 becomes NO. The diagnosis process goes to a step S208, at which the ECU determines whether the engine operation is in the first operating condition or not, namely whether the engine operation is in the region of the lower negative pressure or not. The determination is made based on the downstream-side pressure of the throttle valve, which is detected by the intake-pressure sensor 16. More exactly, determination at the step S208 is YES, when the downstream-side pressure "Pin" (indicated by a solid line in FIG. 2A) of the throttle valve is in a predetermined lower negative-pressure range (lower than "P-T1", for example, in a range between 40 to 65 kPa), which is a pressure range on a side lower than the atmospheric pressure, as shown in FIG. 2A.

When the engine operation is in the first operating condition, the diagnosis process goes to a step S209, at which the electric power is supplied to the air-communication valve 44 so as to close the air-communication valve 44 (CCV) and the second standby flag F2 is turned ON. At a step S210, the electric power is supplied to the purge control valve 46 so as to open the purge control valve 46 (the purge VSV) (corresponding to the time point "t12" in FIG. 2C). In the present embodiment, a duty ratio for power supply to the purge control valve 46 is made to be 100%, so that the purge control valve 46 is fully opened. Then, at a step S211, the ECU determines whether the predetermined time has passed over since the engine operation is detected as being in the first operating condition (corresponding to the time point "t13" in FIG. 2D). In other words, the ECU determines at the step S211 whether the condition of the lower negative pressure has continued for the predetermined time or not. More in detail, the ECU determines whether the downstream-side pressure "Pin" of the throttle valve is in the operating region of the lower negative pressure for the predetermined time or not. The predetermined time is preset at such a time, during which the in-tank pressure does not reach the withstand pressure of the fuel tank 25 after the purge control valve 46 (the purge VSV) is opened.

When the determination at the step S211 is YES, the diagnosis process goes to a step S212. The ECU 60 determines at the step S212 whether the in-tank pressure "Ptk" detected by the in-tank pressure sensor 54 is lower than the first threshold value "P-T1" (FIG. 2D). When the in-tank pressure "Ptk" is lower than the first threshold value "P-T1" (YES at the step S212), the ECU memorizes at a step S213 that none of the purge control valve 46, the first check valve 47 and the second check valve 48 is found as being in an abnormal situation fixed to the valve opened position or the valve closed position (more exactly, the purge control valve 46 is not fixed to the valve closed position, the first check valve 47 is not fixed to the valve closed position and the second check valve 48 is not fixed to the valve opened position). Then, at a step S217, the first determination-end flag is turned ON and the second standby flag F2 is turned OFF. The diagnosis process goes to END. In the above steps S206 and S212, the same determination values (the first threshold value "P-T1") are used. However, different values may be used.

On the other hand, when the in-tank pressure "Ptk" is higher than the first threshold value "P-T1" (NO at the step S212), the diagnosis process goes to a step S214 in order to determine whether the in-tank pressure "Ptk" is lower than the second threshold value "P-T2" (FIG. 2D). When the in-tank pressure "Ptk" is lower than the second threshold value "P-T2" (YES at the step S214), the diagnosis process goes to a step S215, at which the ECU determines that there exists an abnormal situation for the second check valve 48 (the second CV), in which the second check valve 48 is fixed to its valve opened position. When the in-tank pressure "Ptk" is higher than the second threshold value "P-T2" (NO at the step S214), the diagnosis process goes to a step S216, at which the ECU determines that there exists an abnormal situation, in which the purge control valve 46 (the purge VSV) is fixed to the valve closed position or the first check valve 47 (the first CV) is fixed to the valve closed position. Then, the diagnosis process goes to the step S217, at which the first determination-end flag is turned ON and the second standby flag F2 is turned OFF. Then, the diagnosis process goes to END. In the present embodiment, when the first determination-end flag is turned ON, the determination-end flag for the purge VSV fixed to the valve opened position is turned OFF. As a result, the diagnosis for the purge control valve 46 fixed to the valve opened position can be continuously carried out in the subsequent diagnosis process for the operating region of the higher negative pressure.

Figure 9:
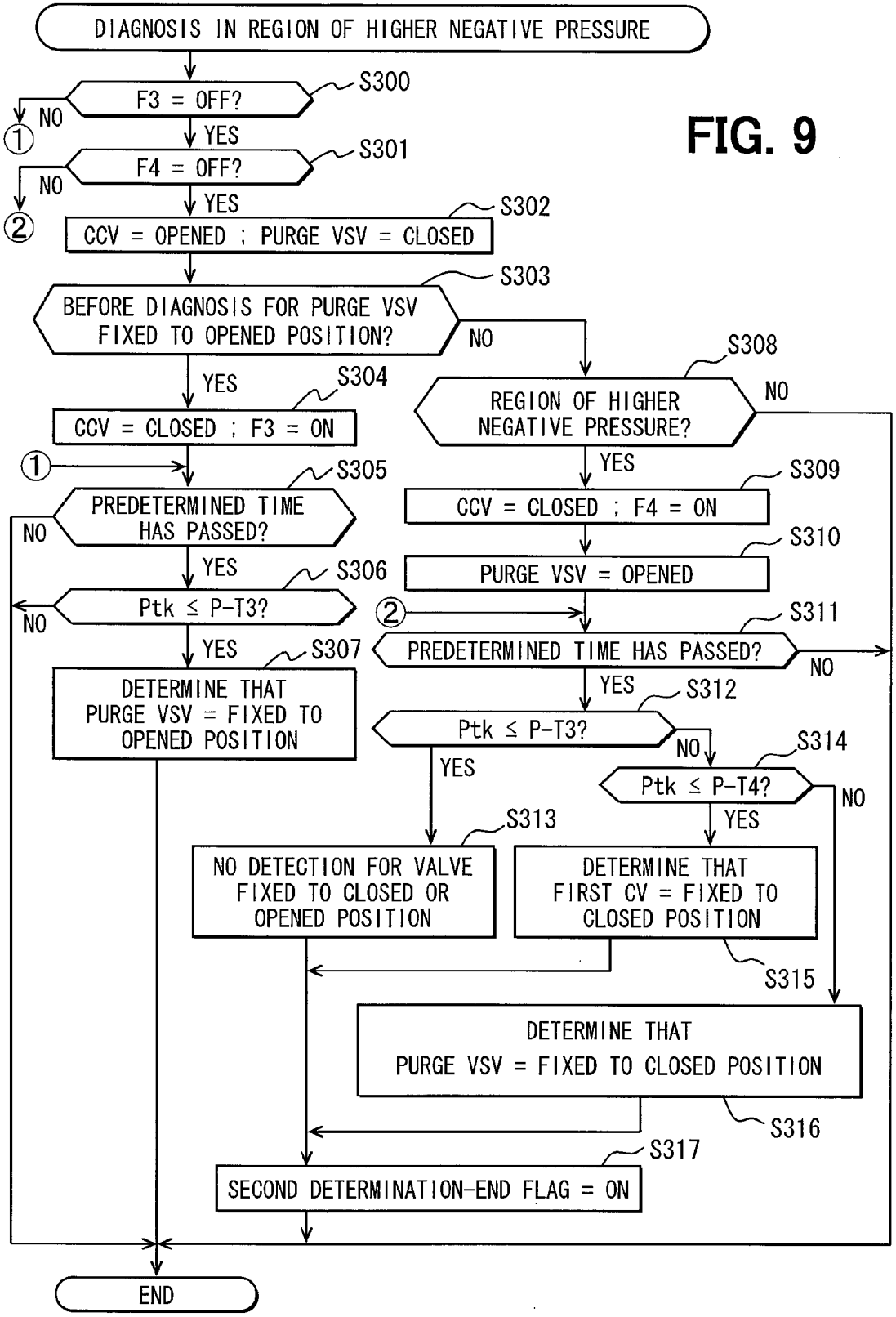
FIG. 9 is a flow-chart showing the process of abnormal diagnosis for air flow in the operating condition of the higher negative pressure.

The process for the abnormal diagnosis in the second operating condition (the operating condition in the operating region of the higher negative pressure) will be explained with reference to FIG. 9. In a flowchart shown in FIG. 9, the ECU 60 determines at a step S300 whether a third standby flag F3 is turned OFF or not, and at a step S301 whether a fourth standby flag F4 is turned OFF or not.

The third standby flag F3 indicates that the ECU is in the condition for waiting the determination, which is made by the ECU whether a predetermined time has passed over since the air-communication valve 44 is closed in the diagnosis for the purge control valve 46 fixed to its valve opened position.

The fourth standby flag F4 indicates that the ECU is in the condition for waiting the determination, which is made by the ECU whether a predetermined time has passed over since the air-communication valve 44 is closed after the diagnosis for the purge control valve 46 fixed to its valve opened position.

Each of the third and fourth standby flags F3 and F4 corresponds to the first and second standby flags F1 and F2, wherein the predetermined time of each of the third and fourth flag F3 and F4 may be equal to or different from the predetermined time of each of the first and second flags F1 and F2.

When both of the third and fourth standby flags F3 and F4 are turned OFF, the diagnosis process goes to a step S302. At the step S302, the supply of the electric power to the air-communication valve 44 (CCV) and the purge control valve 46 (the purge VSV) is cut off, so that the air-communication valve 44 (CCV) is opened, while the purge control valve 46 (the purge VSV) is closed. At a step S303, the ECU determines whether the diagnosis for the purge control valve 46 (the purge VSV) fixed to the valve opened position has been carried out or not. At the step S303, the ECU refers to the determination-end flag for the purge VSV fixed to the valve opened position. When the determination-end flag for the purge VSV is turned ON, the ECU determines that the diagnosis for the purge control valve 46 (the purge VSV) fixed to the valve opened position has been carried out. On the other hand, when the determination-end flag for the purge control valve 46 (the purge VSV) is turned OFF, the ECU determines that the diagnosis for the purge control valve 46 (the purge VSV) fixed to the valve opened position has not yet been carried out.

When YES at the step S303, the diagnosis process goes to a step S304. At the step S304, the electric power is supplied to the air-communication valve 44 (CCV) so that the air-communication valve 44 (CCV) is closed (corresponding to the time point "t21" in FIG. 4B). The third standby flag F3 is turned ON. At a step S305, the ECU 60 determines whether the predetermined time has passed over since the air-communication valve 44 (CCV) is closed.

When YES at the step S305, the diagnosis process goes to a step S306. The ECU 60 determines at the step S306 whether the in-tank pressure "Ptk" detected by the in-tank pressure sensor 54 is lower than the third threshold value "P-T3" (FIG. 4D). When the in-tank pressure "Ptk" is higher than the third threshold value "P-T3" (NO at the step S306), the determination-end flag for the purge VSV fixed to the valve opened position is turned ON and the third standby flag F3 is turned OFF. Then the diagnosis process goes to END.

On the other hand, when YES at the step S306, namely when the in-tank pressure "Ptk" is lower than the third threshold value "P-T3", the diagnosis process goes to a step S307. At the step S307, the ECU determines that there exists an abnormal situation for the purge control valve 46 (the purge VSV), in which the purge control valve 46 is fixed to its valve opened position. In addition, the determination-end flag for the purge VSV fixed to the valve opened position is turned ON, while the third standby flag F3 is turned OFF. Then, the diagnosis process is terminated.

When the diagnosis for the purge control valve 46 (the purge VSV) fixed to the valve opened position has ended, the determination of the step S303 becomes NO. The diagnosis process goes to a step S308, at which the ECU determines whether the engine operation is in the second operating condition or not, namely whether the engine operation is in the region of the higher negative pressure or not. The determination is made based on the downstream-side pressure of the throttle valve, which is detected by the intake-pressure sensor 16. More exactly, determination at the step S308 is YES, when the downstream-side pressure "Pin" of the throttle valve is in a predetermined higher negative-pressure range between "P-I2 and P-I3" (for example, in a range between 70 to 90 kPa), which is a pressure range between the low-pressure determination value "P-I1" and the atmospheric pressure, as shown in FIG. 4A.

When the engine operation is in the second operating condition, the diagnosis process goes to a step S309, at which the electric power is supplied to the air-communication valve 44 so as to close the air-communication valve 44 (CCV) and the fourth standby flag F4 is turned ON. At a step S310, the electric power is supplied to the purge control valve 46 so as to open the purge control valve 46 (the purge VSV) (corresponding to the time point "t22" in FIG. 4C). In the present embodiment, the duty ratio for power supply to the purge control valve 46 is made to be 100%, so that the purge control valve 46 is fully opened. Then, at a step S311, the ECU determines whether the predetermined time has passed over since the engine operation is detected as being in the second operating condition (corresponding to the time point "t23" in FIG. 4D). In other words, the ECU determines at the step S311 whether the condition of the higher negative pressure has continued for the predetermined time or not. More in detail, the ECU determines whether the downstream-side pressure "Pin" of the throttle valve is in the operating region of the higher negative pressure (the higher negative-pressure range "P-I2-P-I3") for the predetermined time or not. The predetermined time is preset at such a time, during which the in-tank pressure does not reach the withstand pressure of the fuel tank 25 after the purge control valve 46 (the purge VSV) is opened.

When the determination at the step S311 is YES, the diagnosis process goes to a step S312. The ECU 60 determines at the step S312 whether the in-tank pressure "Ptk" detected by the in-tank pressure sensor 54 is lower than the third threshold value "P-T3" (FIG. 4D). When the in-tank pressure "Ptk" is lower than the third threshold value "P-T3" (YES at the step S312), the ECU memorizes at a step S313 that none of the purge control valve 46, the first check valve 47 and the second check valve 48 is found as being in an abnormal situation fixed to the valve opened position or the valve closed position (more exactly, the purge control valve 46 is not fixed to the valve closed position, the first check valve 47 is not fixed to the valve closed position). Then, at a step S317, the second determination-end flag is turned ON. The diagnosis process goes to END. In the above steps S306 and S312, the same determination values (the third threshold value "P-T3") are used. However, different values may be used.

On the other hand, when the in-tank pressure "Ptk" is higher than the third threshold value "P-T3" (NO at the step S312), the diagnosis process goes to a step S314 in order to determine whether the in-tank pressure "Ptk" is lower than the fourth threshold value "P-T4" (FIG. 4D). When the in-tank pressure "Ptk" is lower than the fourth threshold value "P-T4" (YES at the step S314), the diagnosis process goes to a step S315, at which the ECU determines that there exists an abnormal situation for the first check valve 47 (the first CV), in which the first check valve 47 is fixed to its valve closed position. When the in-tank pressure "Ptk" is higher than the fourth threshold value "P-T4" (NO at the step S314), the diagnosis process goes to a step S316, at which the ECU determines that there exists an abnormal situation, in which the purge control valve 46 (the purge VSV) is fixed to the valve closed position. Then, the diagnosis process goes to the step S317, at which the second determination-end flag is turned ON and the fourth standby flag F4 is turned OFF. Then, the diagnosis process goes to END. In the present embodiment, when the second determination-end flag is turned ON, the determination-end flag for the purge VSV fixed to the valve opened position is turned OFF. As a result, the diagnosis for the purge control valve 46 fixed to the valve opened position can be further carried out in the subsequent diagnosis process for the operating region of the supercharging operation.

Figure 10:
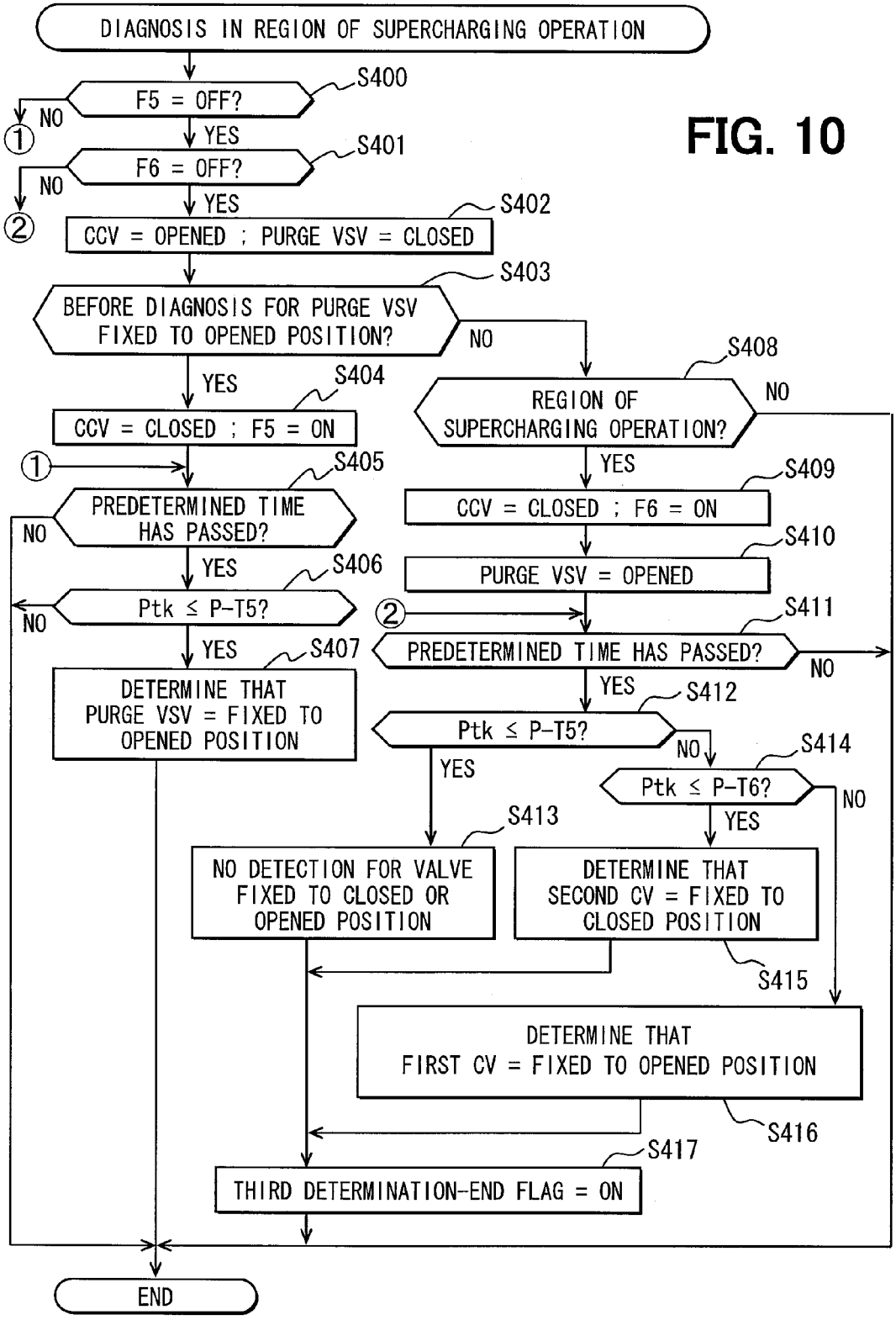
FIG. 10 is a flow-chart showing the process of abnormal diagnosis for air flow in the supercharge operating condition.

The process for the abnormal diagnosis in the third operating condition (the operating condition in the operating region of the supercharging operation) will be explained with reference to FIG. 10. In a flowchart shown in FIG. 10, the ECU 60 determines at a step S400 whether a fifth standby flag F5 is turned OFF or not, and at a step S401 whether a sixth standby flag F6 is turned OFF or not.

The fifth standby flag F5 (like the first and third standby flags F1 and F3) indicates that the ECU is in the condition for waiting the determination, which is made by the ECU whether a predetermined time has passed over since the air-communication valve 44 is closed in the diagnosis for the purge control valve 46 fixed to its valve opened position.

The sixth standby flag F6 (like the second and fourth standby flags F2 and F4) indicates that the ECU is in the condition for waiting the determination, which is made by the ECU whether a predetermined time has passed over since the air-communication valve 44 is closed after the diagnosis for the purge control valve 46 fixed to its valve opened position.

When both of the fifth and sixth standby flags F5 and F6 are turned OFF, the diagnosis process goes to a step S402. At the step S402, the supply of the electric power to the air-communication valve 44 (CCV) and the purge control valve 46 (the purge VSV) is cut off, so that the air-communication valve 44 (CCV) is opened, while the purge control valve 46 (the purge VSV) is closed. At a step S403, the ECU determines whether the diagnosis for the purge control valve 46 (the purge VSV) fixed to the valve opened position has been carried out or not. At the step S403, the ECU refers to the determination-end flag for the purge VSV fixed to the valve opened position. When the determination-end flag for the purge VSV is turned ON, the ECU determines that the diagnosis for the purge control valve 46 (the purge VSV) fixed to the valve opened position has been carried out. On the other hand, when the determination-end flag for the purge control valve 46 (the purge VSV) is turned OFF, the ECU determines that the diagnosis for the purge control valve 46 (the purge VSV) fixed to the valve opened position has not yet been carried out.

When YES at the step S403, the diagnosis process goes to a step S404. At the step S404, the electric power is supplied to the air-communication valve 44 (CCV) so that the air-communication valve 44 (CCV) is closed (corresponding to the time point "t31" in FIG. 6B). The fifth standby flag F5 is turned ON. At a step S405, the ECU 60 determines whether the predetermined time has passed over since the air-communication valve 44 (CCV) is closed.

When YES at the step S405, the diagnosis process goes to a step S406. The ECU 60 determines at the step S406 whether the in-tank pressure "Ptk" detected by the in-tank pressure sensor 54 is lower than the fifth threshold value "P-T5" (FIG. 6D). When the in-tank pressure "Ptk" is higher than the fifth threshold value "P-T5" (NO at the step S406), the determination-end flag for the purge VSV fixed to the valve opened position is turned ON and the fifth standby flag F5 is turned OFF. Then the diagnosis process goes to END.

On the other hand, when YES at the step S406, namely when the in-tank pressure "Ptk" is lower than the fifth threshold value "P-T5", the diagnosis process goes to a step S407. At the step S407, the ECU determines that there exists an abnormal situation for the purge control valve 46 (the purge VSV), in which the purge control valve 46 is fixed to its valve opened position. In addition, the determination-end flag for the purge VSV fixed to the valve opened position is turned ON, while the fifth standby flag F5 is turned OFF. Then, the diagnosis process is terminated.

When the diagnosis for the purge control valve 46 (the purge VSV) fixed to the valve opened position has ended, the determination of the step S403 becomes NO. The diagnosis process goes to a step S408, at which the ECU determines whether the engine operation is in the third operating condition or not, namely whether the engine operation is in the region of the supercharging operation or not. The determination is made based on the downstream-side pressure of the throttle valve, which is detected by the intake-pressure sensor 16. More exactly, determination at the step S408 is YES, when the downstream-side pressure "Pin" of the throttle valve is higher than a supercharge determination value "P-I4" (for example, higher than 110 kPa), which is a pressure range on a side higher than the atmospheric pressure, as shown in FIG. 6A.

When the engine operation is in the third operating condition, the diagnosis process goes to a step S409, at which the electric power is supplied to the air-communication valve 44 so as to close the air-communication valve 44 (CCV) and the sixth standby flag F6 is turned ON. At a step S410, the electric power is supplied to the purge control valve 46 so as to open the purge control valve 46 (the purge VSV) (corresponding to the time point "t32" in FIG. 6C). In the present embodiment, the duty ratio for power supply to the purge control valve 46 is made to be 100%, so that the purge control valve 46 is fully opened. Then, at a step S411, the ECU determines whether the predetermined time has passed over since the engine operation is detected as being in the third operating condition (corresponding to the time point "t33" in FIG. 6D). In other words, the ECU determines at the step S411 whether the condition of the supercharging operation has continued for the predetermined time or not. More in detail, the ECU determines whether the downstream-side pressure "Pin" of the throttle valve is higher than the supercharge determination value "P-I4" for the predetermined time or not.

When the determination at the step S411 is YES, the diagnosis process goes to a step S412. The ECU 60 determines at the step S412 whether the in-tank pressure "Ptk" detected by the in-tank pressure sensor 54 is lower than the fifth threshold value "P-T5" (FIG. 6D). When the in-tank pressure "Ptk" is lower than the fifth threshold value "P-T5" (YES at the step S412), the ECU memorizes at a step S413 that none of the purge control valve 46, the first check valve 47 and the second check valve 48 is found as being in an abnormal situation fixed to the valve opened position or the valve closed position (more exactly, the purge control valve 46 is not fixed to the valve closed position, the first and second check valves 47 and 48 are not fixed to the valve closed positions or to the valve opened positions). Then, at a step S417, the third determination-end flag is turned ON and the sixth standby flag F6 is turned OFF. The diagnosis process goes to END. In the above steps S406 and S412, the same determination values (the fifth threshold value "P-T5") are used. However, different values may be used.

On the other hand, when the in-tank pressure "Ptk" is higher than the fifth threshold value "P-T5" (NO at the step S412), the diagnosis process goes to a step S414 in order to determine whether the in-tank pressure "Ptk" is lower than the sixth threshold value "P-T6" (FIG. 6D). When the in-tank pressure "Ptk" is lower than the sixth threshold value "P-T6" (YES at the step S414), the diagnosis process goes to a step S415, at which the ECU determines that there exists an abnormal situation for the second check valve 48 (the second CV), in which the second check, valve 48 is fixed to its valve closed position. When the in-tank pressure "Ptk" is higher than the sixth threshold value "P-T6" (NO at the step S414), the diagnosis process goes to a step S416, at which the ECU determines that there exists an abnormal situation, in which the first check valve 47 (the first CV) is fixed to the valve opened position. Then, the diagnosis process goes to the step S417, at which the third determination-end flag is turned ON and the sixth standby flag F6 is turned OFF. Then, the diagnosis process goes to END.

The vaporized fuel processing apparatus of the present embodiment has the following advantages:

In the vaporized-fuel processing system or apparatus, in which two purge passages are provided, each of the upstream-side pressure of the throttle valve and the downstream-side pressure of the throttle valve is determined whether each pressure is at the atmospheric pressure, the positive pressure (with respect to the atmospheric pressure) or the negative pressure (with respect to the atmospheric pressure). In addition, the change of the in-tank pressure of the fuel tank 25 is detected in the condition that the air-communication valve 44 is closed but the purge control valve 46 is opened. Then, the respective abnormal conditions for the purge control valve 46, the first check valve 47 and the second check valve 48 (whether each of them is fixed to the valve opened position or to the valve closed position) are identified, based on the above determination result for the upstream-side and the downstream-side pressure as well as the change of the in-tank pressure. According to the above features, it is possible to identify the respective contents of the abnormal conditions for the purge control valve 46, the first check valve 47 and the second check valve 48, so that diagnosis accuracy for the air flow is increased for the vaporized-fuel processing apparatus having two purge passages.

As explained above, the contents of the abnormal conditions, which can be identified in the present embodiment, differ from the operating condition to the operating condition of the engine. Namely, the contents of the abnormal conditions to be identified are different from each other in the following engine operating conditions:

(1) the first operating condition, in which the upstream-side pressure of the throttle valve is almost atmospheric pressure but the downstream-side pressure of the throttle valve is the negative pressure;

(2) the second operating condition, in which the upstream-side pressure of the throttle valve is the positive pressure but the downstream-side pressure of the throttle valve is the negative pressure; and (3) the third operating condition, in which both of the upstream-side and the downstream-side pressures of the throttle valve are the positive pressure.

In the present embodiment, the change of the in-tank pressure of the fuel tank 25 is detected in the above respective engine operating conditions, in the condition that the air-communication valve 44 is closed and the purge control valve 46 is opened. The abnormal conditions for the purge control valve 46, the first check valve 47 and the second check valve 48 are diagnosed based on the detection results of the above change of the in-tank pressure in each of the engine operating conditions, namely which of the valves is not in the normal condition and whether the valve is fixed to the valve opened position or to the valve closed condition. According to the above features, it is possible to identify all kinds of the abnormal conditions of the valves (fixed to the valve opened or closed position), except for the abnormal condition in which the purge control valve 46 is fixed to the valve opened position.

According to the present embodiment, however, the change of the in-tank pressure of the fuel tank 25 is further detected in the condition that the electric power is not supplied to the purge control valve 46 (the purge control valve 46 is the normally closed type valve) and the air-communication valve 44 is closed. Whether the purge control valve 46 is fixed to the valve opened position or not is determined based on the change of the above in-tank pressure. As a result, according to the present embodiment, it is possible to identify all kinds of the abnormal conditions of the purge control valve 46, the first check valve 47 and the second check valve 48 (whether any one of the valves is fixed to the valve opened or closed position).

For example, in a case that the abnormal diagnosis for the third operating condition is carried out at first, the abnormal diagnosis is made as below. When the in-tank pressure of the fuel tank 25 is not changed in the condition that the air-communication valve 44 is closed and the purge control valve 46 is opened, there are two possibilities. Namely, the above situation is caused by either because the second check valve 48 is fixed to the valve closed position or because the purge control valve 46 is fixed to the valve closed position. Accordingly, when the in-tank pressure of the fuel tank 25 is not changed in the condition that the air-communication valve 44 is closed and the purge control valve 46 is opened, it is necessary to provisionally determine that the second check valve 48 is fixed to the valve closed position or that the purge control valve 46 is fixed to the valve closed position. And then, a final determination should be made which one of the above two cases is correct, based on the diagnosis result for the second operating condition.

According to the present embodiment, however, the abnormal diagnosis is carried out for the respective engine operating conditions in the order of the first operating condition, the second operating condition and the third operating condition, based on the change of the in-tank pressure in the condition that the air-communication valve 44 is closed and the purge control valve 46 is opened during the engine operation. It is, therefore, possible to smoothly carry out the abnormal diagnosis (smoothly identify the abnormal condition) of the purge control valve 46, the first check valve 47 and the second check valve 48.

According to the present embodiment, as already explained above, the abnormal diagnosis is made based on the change of the in-tank pressure of the fuel tank 25 in the condition that the air-communication valve 44 is closed and the purge control valve 46 is opened. The change of the in-tank pressure of the fuel tank 25 is detected in the following manner. At first, the in-tank pressure is detected after the predetermined time has passed over since the air-communication valve 44 is closed and the purge control valve 46 is opened. Then, the detected in-tank pressure is compared with the multiple pressure threshold values. According to such features, the abnormal diagnosis can be done before the in-tank pressure reaches the withstand pressure of the fuel tank. Therefore, it is possible to carry out the abnormal diagnosis for the respective valves provided in each of the purge passages, while satisfying restriction for the withstand pressure of the fuel tank.

(Second Embodiment)

In the above first embodiment, the abnormal diagnosis for the air flow is carried out during the engine operation for the vaporized-fuel processing apparatus 40. According to a second embodiment of the present disclosure, the engine has an evaporative leak check module (hereinafter, ELCM) for diagnosing a possible leak of the vaporized fuel. According to the present embodiment, therefore, the abnormal diagnosis for the air flow is carried out by use of the ELCM for the vaporized-fuel processing apparatus 40 not only during the engine operation but also during a period in which the engine operation is stopped. Hereinafter, such portions different from the first embodiment are mainly explained.

Figure 11:
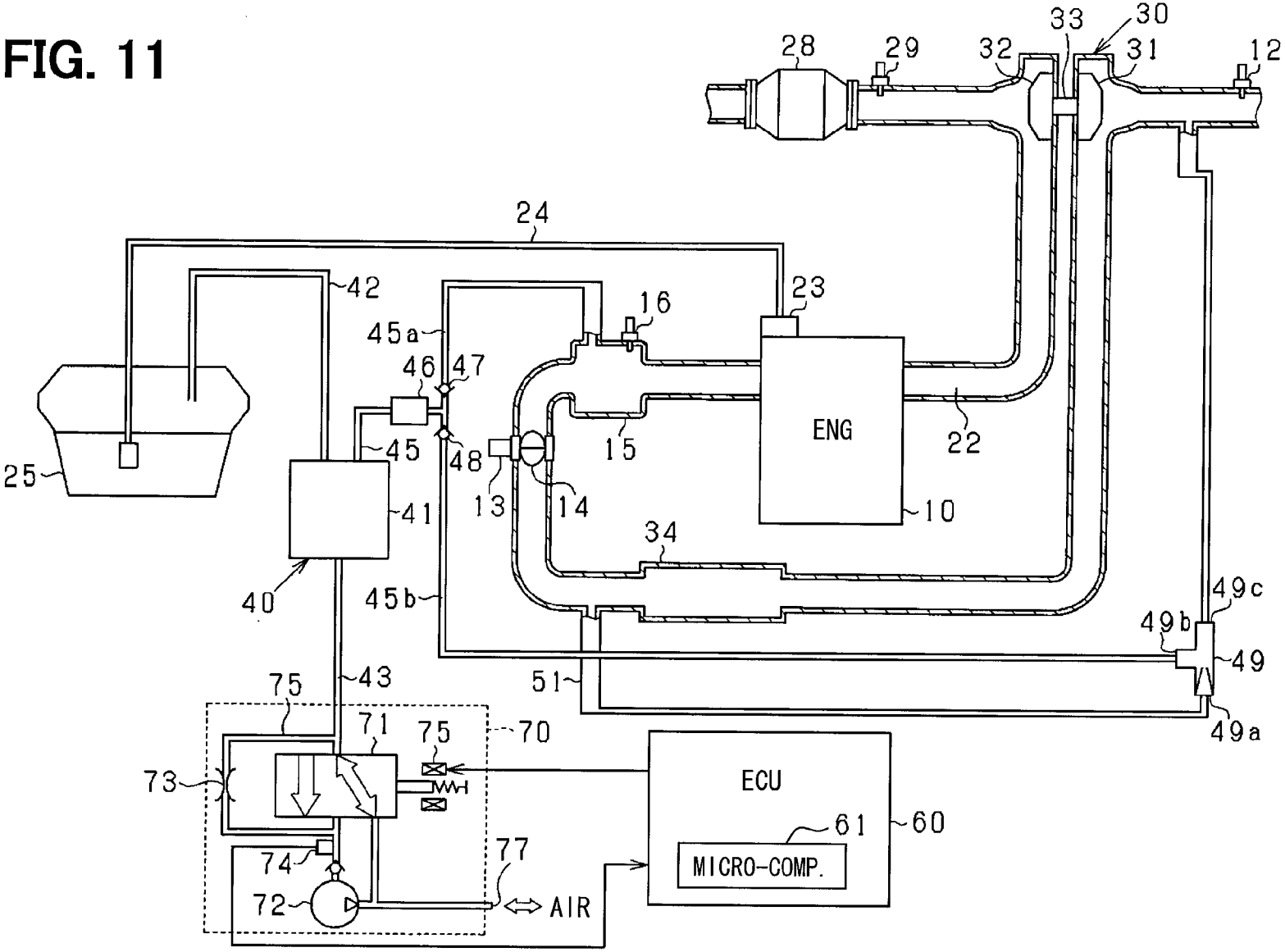
FIG. 11 is a schematic view showing an entire structure for an engine control system according to a second embodiment of the present disclosure.

FIG. 11 shows an entire structure for the vaporized-fuel processing system according to the second embodiment of the present disclosure. The ELCM 70 is provided in the air-communication pipe 43 for communicating the canister 41 to the atmospheric air. The ELCM 70 is composed of a switching valve 71 for switching a first valve position for communicating the canister 41 to the atmospheric air to a second valve position for cutting off the communication between the canister 41 and the atmospheric air, a vacuum pump 72 for decreasing the pressure in the related parts and portions, a reference orifice 73 having a restriction of a reference leak diameter, and a pressure sensor 74 for detecting the pressure.

More in detail, the switching valve 71 of the ELCM 70 is provided in the air-communication pipe 43. When electric power is supplied to a coil 75, a valve position is switched from the first valve position to the second valve position. In the first valve position (an air-communication position), the canister 41 is connected to an open end 77 of the air-communication pipe 43. In the second valve position (an air-communication cut-off position), the canister 41 is connected to an air suction side of the vacuum pump 72. In FIG. 11, the first valve position is shown, wherein the electric power supply to the coil 75 is cut off. A bypass passage 76 is provided for the air-communication pipe 43. The bypass passage 76 connects an air-inlet side of the canister 41 to the air suction side of the vacuum pump 72. The reference orifice 73 is provided in the bypass passage 76. The reference orifice 73 has the restriction of the reference leak diameter, which is, for example, 0.45 mm. The pressure sensor 74 is provided in the bypass passage 76 at the air suction side of the vacuum pump 72 for detecting the air pressure in the ELCM 70 as well as the pressure for the reference orifice 73.

Figures 12A, 12B, 12C, 12D:
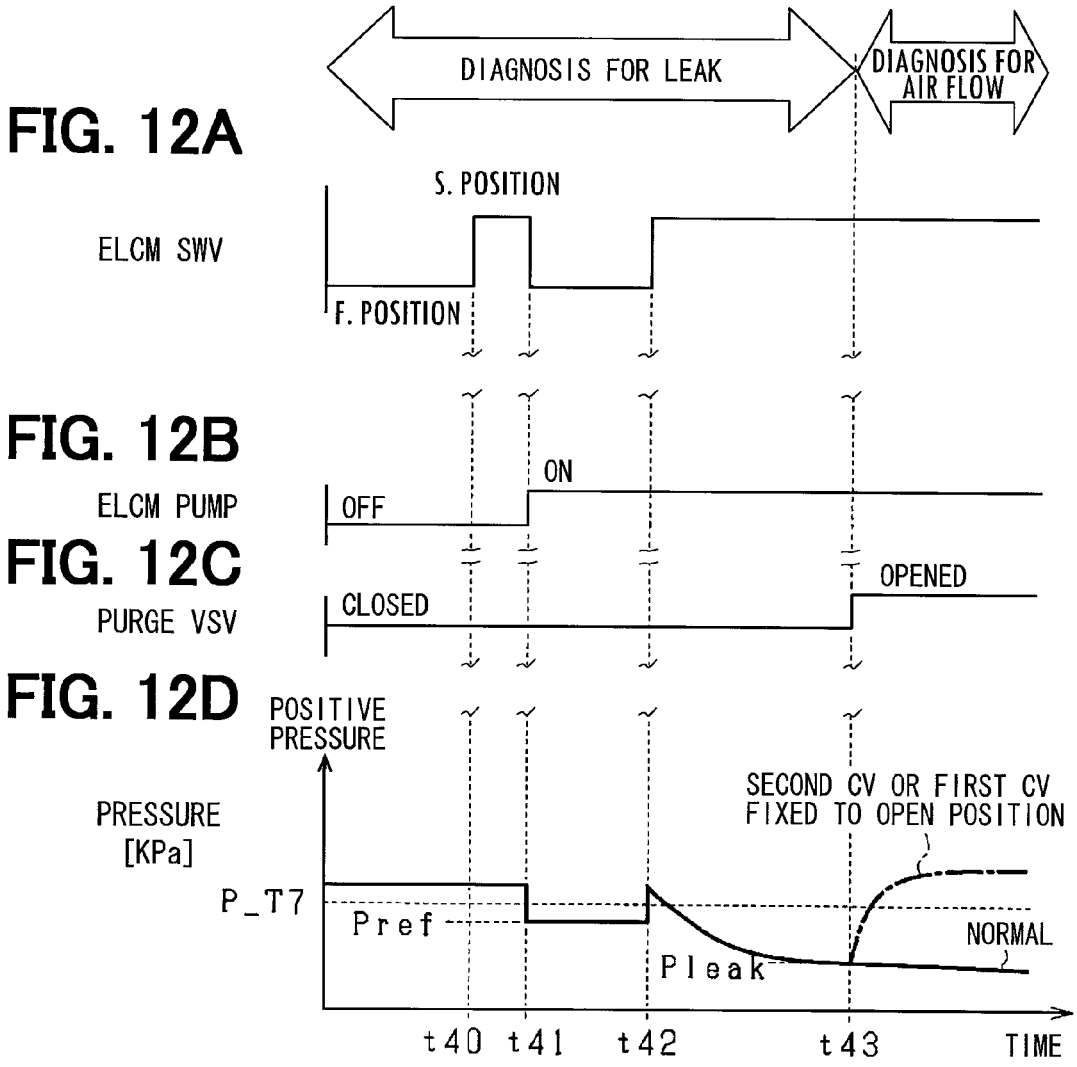
FIGS. 12A to 12D are time charts showing a process of abnormal diagnosis for air flow when an engine operation is stopped.

A process for diagnosing leak of the vaporized fuel, which is executed by the ELCM 70, will be explained with reference to FIGS. 12A to 12D. When a condition for executing the leak diagnosis is satisfied during the period in which the engine operation is stopped (for example, when a predetermined time has passed over since the stop of the engine operation), the vacuum pump (the ELCM pump) 72 is turned on at a time point "t41" (FIG. 12B) in a condition that the switching valve 71 is changed to its first valve position (FIG. 12A). Then, the pressure for the reference orifice 73 is decreased. The micro-computer 61 of the ECU 60 measures a saturated pressure "Pref" in this operation (FIG. 12D). The saturated pressure "Pref" is also referred to as a reference pressure "Pref". In the present embodiment, the switching valve 71 is changed from the first valve position to the second valve position before the time point "t41", so that a reference level is adjusted. At a time point "t42" after measuring the saturated pressure "Pref", the switching valve is changed from the first valve position to the second valve position (FIG. 12A) in order to decrease the pressure of an evaporation system, which includes the canister 41 and the fuel tank 25. The micro-computer 61 of the ECU 60 measures a saturated pressure "Pleak" in this operation (FIG. 12D). The saturated pressure "Pleak" is also referred to as a leak-check pressure "Pleak". Then, the leak-check pressure "Pleak" is compared with the reference pressure "Pref". The ECU 60 determines that there occurs no leak of the vaporized fuel when the leak-check pressure is smaller than the reference pressure ("Pleak"<"Pref"). On the other hand, the ECU 60 determines that there occurs leak of the vaporized fuel when the leak-check pressure is larger than the reference pressure ("Pleak">"Pref").

In the present embodiment, the abnormal diagnosis for the air flow is carried out during the period in which the engine operation is stopped, after the above leak diagnosis. As shown in FIG. 12C, the electric power is supplied to the purge control valve 46 (the purge VSV) at a time point "t43" so as to open the purge control valve 46, in the condition that the switching valve (the ELCM valve) 71 is maintained at the second valve position (FIG. 12A) and the vacuum pump (the ELCM pump) 72 is maintained in its operation (FIG. 12B). When all of the purge control valve 46, the first check valve 47 and the second check valve 48 are normally operated, the pressure detected by the pressure sensor 74 is maintained at the pressure indicated by a solid line in FIG. 12D.

On the other hand, when the second check valve 48 is fixed to the valve opened position, the fresh air flows from the most upstream side of the intake-air passage 11 into the canister 41 via the second purge passage 45*b*, due to the air suction force of the vacuum pump 72. As a result, the pressure detected by the pressure sensor 74 is increased to be higher than the leak-check pressure "Pleak", as indicated by a one-dot-chain line in FIG. 12D. More exactly, the pressure detected by the pressure sensor 74 is increased to a value equal to or almost equal to the atmospheric pressure.

In a similar manner to the above situation (the second check valve 48 is fixed to the valve opened position), when the first check valve 47 is fixed to the valve opened position, the intake air likewise flows from the downstream side of the throttle valve into the canister 41 via the first purge passage 45*a*, due to the air suction force of the vacuum pump 72. Therefore, the pressure detected by the pressure sensor 74 is increased to the value higher than the leak-check pressure "Pleak", as indicated by the one-dot-chain line in FIG. 12D.

The present embodiment uses the above phenomena. The abnormal diagnosis for the first and second check valves 47 and 48 fixed to the valve opened positions is made based on the change of the pressure detected by the pressure sensor 74, in the condition that the switching valve (the ELCM valve) 71 is closed (FIG. 12A) and the purge control valve (the purge VSV) 46 is opened (FIG. 12C) during the period in which the engine operation is stopped.

According to the present embodiment, the abnormal diagnosis for the air flow is also carried out during the engine operation, in order to diagnose whether any valve (the purge control valve 46, the first check valve 47 and the second check valve 48) is fixed to either the valve opened position or to the valve closed position. The abnormal diagnosis for the air flow, which is carried out during the engine operation, is basically the same to that of the first embodiment, except for the air-communication valve 44 is replaced by the switching valve 71 in the second embodiment.

The abnormal diagnosis for the air flow during the period, in which the engine operation is stopped, will be explained with reference to FIG. 13. The process for the abnormal diagnosis during the non-operation of the engine is periodically carried out by the micro-computer 61 of the ECU 60 at the predetermined cycle, after the abnormal diagnosis during the engine operation.

Figure 13:
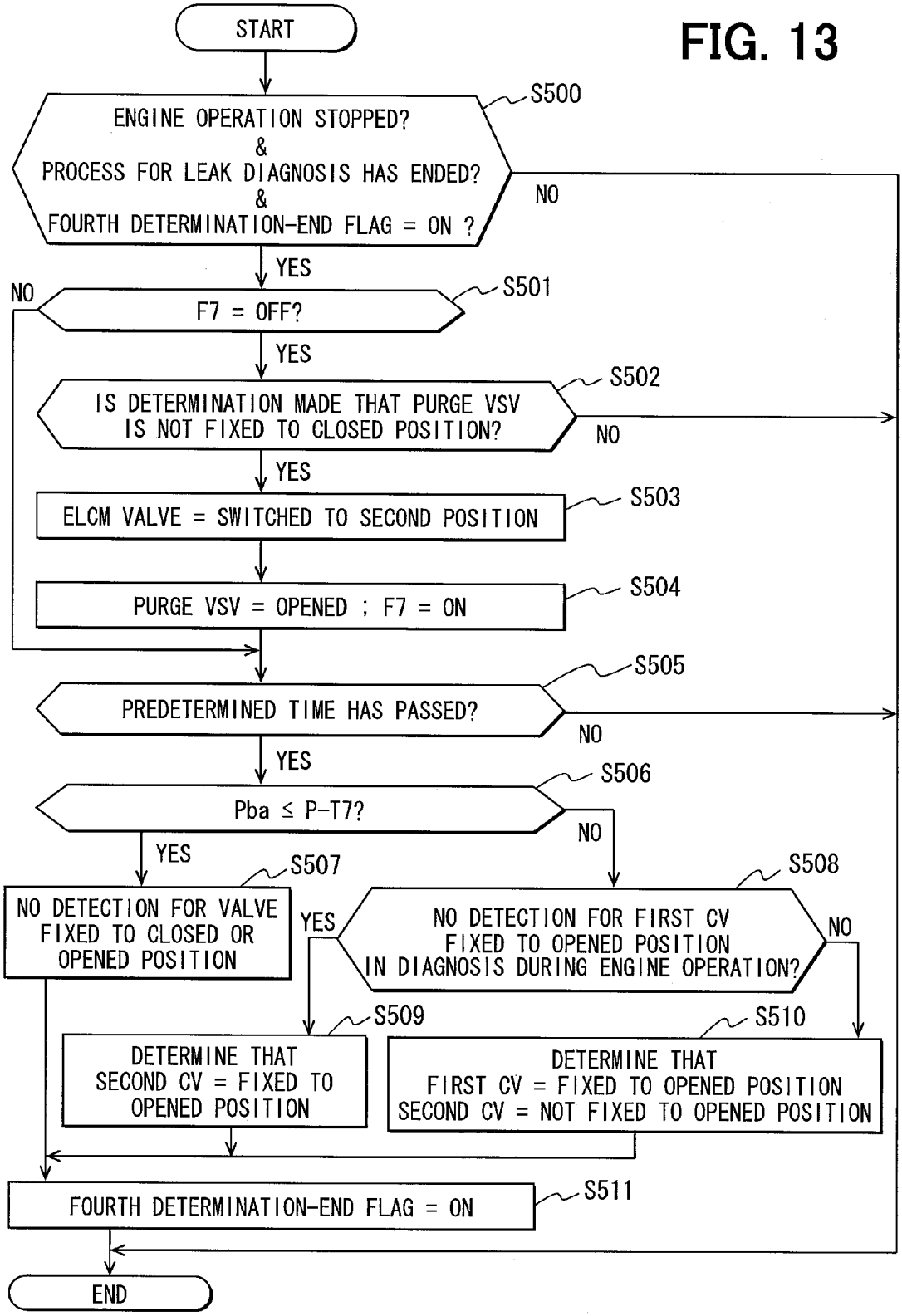
FIG. 13 is a flow-chart showing the process of abnormal diagnosis for air flow when the engine operation is stopped.

In FIG. 13, the ECU determines at a step S500 whether the engine operation is stopped or not, whether the process for the leak diagnosis has ended or not, and whether a fourth determination-end flag is turned ON or not. The fourth determination-end flag corresponds to a flag indicating that the process for the abnormal diagnosis for the air flow has been completed or not during the non-operation of the engine. When the flag is ON, it shows that the process for the abnormal diagnosis has been carried out. When the above conditions are satisfied at the step S500, the diagnosis process goes to a step S501, in order to determine whether a seventh standby flag F7 is turned OFF or not. The seventh standby flag F7 indicates that the ECU is in a condition for waiting a determination, which is made by the ECU whether a predetermined time has passed over since the purge control valve 46 is opened. In case of F7=OFF, the diagnosis process goes to a step S502.

At the step S502, the ECU determines whether the determination for the purge control valve 46 (the purge VSV) fixed to the valve closed position is already made in the abnormal diagnosis during the engine operation and whether the purge control valve 46 is determined as being normally operated. When YES at the step S502, the electric power is supplied to the coil 75 at a step S503 so as to switch the valve position to the second valve position (corresponding to the time point "t42" in FIG. 12B). Then, after a predetermined time (corresponding to the time point "t43" in FIG. 12C), at a step S504, the electric power is supplied to the purge control valve 46 so as to open the purge control valve 46. At a step S505, the ECU determines whether a predetermined time has passed over or not since the purge control valve 46 is opened. After the predetermined time, at a step S506, the ECU determines whether the pressure "Pba" detected by the pressure sensor 74 is lower than a seventh threshold value "P-T7" or not.

When the pressure "Pba" is lower than the seventh threshold value "P-T7" ("Pba"<"P-T7"), the ECU determines at a step S507 that none of the purge control valve 46, the first check valve 47 and the second check valve 48 is found as being in any abnormal situation fixed to the valve opened position or the valve closed position. On the other hand, in case of "Pba">"P-T7", the diagnosis process goes to a step S508, at which the ECU determines whether the determination was made for the first check valve 47 during the engine operation and whether the first check valve 47 was determined as being not fixed to the valve opened position. When the determination was made that the first check valve 47 was not fixed to the valve opened position, the ECU determines at a step S509 that the second check valve 48 is fixed to the valve opened position.

On the other hand, when the determination was made in the abnormal diagnosis during the engine operation that the first check valve was fixed to the valve opened position, the determination of the step S508 is NO. The diagnosis process goes to a step S510, at which the ECU determines that the second check valve 48 is not fixed to the valve opened position. Then, at a step S511, a fourth determination-end flag is turned ON.

According to the above second embodiment, the same advantages to the first embodiment can be obtained. In addition, the second embodiment has further advantages as below.

In the embodiment, in which the electromagnetic valve for controlling the communication between the canister 41 and the atmospheric air is replaced by the ELCM 70, it is possible to identify the valve (among the purge control valve 46, the first check valve 47 and the second check valve 48), which is fixed to the valve closed position or to the valve opened position. It is further possible to detect whether each of the first and second check valves 47 and 48 is fixed to the valve opened position, through the diagnosis during the non-operation of the engine.

According to the second embodiment, the abnormal diagnosis for the air flow is carried out during the non-operation of the engine, after the abnormal diagnosis for the air flow during the engine operation. It is, therefore, possible by use of the result of the abnormal diagnosis during the engine operation to determine whether the second check valve 48 is fixed to the valve opened position and whether the first check valve 47 is fixed to the valve opened position. More exactly, in the condition that the first check valve 47 is already determined as being not fixed to the valve opened position in the diagnosis during the engine operation, when the pressure "Pba" is larger than the seventh threshold value "P-T7" ("Pba">"P-T7") in the diagnosis during the non-operation of the engine, it is possible to determine that the second check valve 48 is fixed to the valve opened position. Furthermore, in the condition that the second check valve 48 is already determined as being not fixed to the valve opened position in the diagnosis during the engine operation, when the pressure "Pba" is larger than the seventh threshold value "P-T7" ("Pba">"P-T7") in the diagnosis during the non-operation of the engine, it is possible to determine that the first check valve 47 is fixed to the valve opened position.

(Further Embodiments and/or Modifications)

The present disclosure should not be limited to the above embodiments, but may be modified in various manners as below:

(1) In the above embodiments, a condition that HC concentration in the canister 41 (an absorbed amount of HC) is lower than a predetermined value can be added as one of the conditions for executing the abnormal diagnosis for the air flow. According to such a modification, it is possible to prevent decrease of accuracy for controlling an air-fuel ratio. More exactly, the determination (whether the HC concentration in the canister 41 is lower than the predetermined value) is carried out before the determination whether the purge control valve 46 is fixed to the valve opened position or not in each operating condition (that is, the first operating condition of the lower negative pressure, the second operating condition of the higher negative pressure and the third operating condition of the supercharging operation). For example, in the first operating condition of the lower negative pressure, the determination whether the HC concentration in the canister 41 is lower than the predetermined value or not is made after the step S203 of FIG. 8. For example, the detection for the HC concentration can be calculated based on an engine operating condition, or a sensor is provided in the canister 41 for detecting the absorbed amount of HC in the canister 41. When the HC concentration is lower than the predetermined value, the subsequent steps S204 to S207 are carried out. On the other hand, when the HC concentration is higher than the predetermined value, the diagnosis control of FIG. 8 is not further carried out and goes to END.

In the above modification, the determination whether the HC concentration is lower than the predetermined value or not is made in the abnormal diagnosis of the respective operating conditions. The step for determining whether the HC concentration is lower than the predetermined value or not can be carried out is inserted in the main routine of FIG. 7 at such a portion before each of execution of the diagnosis.

(2) In the above embodiments, the duty ratio of the electric power supply to the purge control valve 46 is controlled at 100% (fully opened), for example, in the abnormal diagnosis for the operating condition of the lower negative pressure. According to a modification, the abnormal diagnosis is carried out with a duty ratio of the electric power supply, which is less than 100%.

In the case that the second check valve 48 is fixed to the valve opened position, the fresh air flows through the upstream side of the intake-air compressor 31, the second purge passage 45*b*, the first purge passage 45*a* and the downstream side of the throttle valve 14, when the air-communication valve 44 is closed but the purge control valve 46 is opened in the operating condition of the lower negative pressure. As a result, the in-tank pressure is decreased (as indicated by the one-dot-chain line in FIG. 2D).

When an amount of the air flow (flowing in the reversed direction from the ejector 49) is too small with respect to the amount of the purging operation from the fuel tank 25, it may become difficult to differentiate the abnormal condition from the normal condition. For example, a total amount of the air flow discharged into the downstream side of the throttle valve 14 is assumed to be "10". A first case is assumed that an amount of the purging operation from the fuel tank 25 is "8", while an amount of the air from the ejector 49 is "2". A second case is assumed that the amount of the purging operation from the fuel tank 25 is "5", while the amount of the air from the ejector 49 is "5". When compared the first case with the second case, the decrease of the in-tank pressure in the second case is smaller than that of the first case. Therefore, in the second case, it is possible to more easily and surely differentiate the abnormal condition from the normal condition.

According to the modification, therefore, the abnormal diagnosis is carried out, wherein the duty ratio of the electric power supply to the purge control valve 46 is controlled to be the value smaller than 100%. In other words, the purge control valve 46 is not fully opened but partially opened at an intermediate valve position. More exactly, the duty ratio of the electric power supply is controlled at a value between 30 and 60% (for example, at 50%). Alternatively, the duty ratio for the electric power supply in the abnormal diagnosis in the operating condition of the lower negative pressure is made to be value smaller than that (for example, 100%) for the abnormal diagnosis in the operating condition of the higher negative pressure and in the operating condition of the supercharging operation. According to the above feature, the change of the in-tank pressure can be controlled at a smaller value when the air-communication valve 44 is closed and the purge control valve 46 is opened, in the case that the second check valve 48 is fixed to the valve opened position. It is, therefore, possible to differentiate the change of the in-tank pressure in case of the abnormal condition from the change of the in-tank pressure in case of the normal condition. As above, the accuracy for the abnormal diagnosis is increased.

(3) In the above embodiments, the in-tank pressure is detected after the predetermined time has passed over since the purge control valve 46 is switched to the valve opened position, and such detected in-tank pressure is compared with the respective threshold values, in order to carry out the abnormal diagnosis based on the change of the in-tank pressure. According to a modification, a changing ratio (a gradient) of the in-tank pressure is detected during the predetermined time period since the purge control valve 46 is switched to the valve opened position, and such changing ratio is compared with a predetermined value so as to carry out the abnormal diagnosis. For example, in the case of determining whether the second check valve 48 is fixed to the valve opened position or not in the operating condition of the lower negative pressure, that is, in the case of the step S214 of FIG. 8, the changing ratio of the in-tank pressure is detected based on multiple detection values of the pressure sensor 54. When the detected changing ratio is lower than the predetermined value, in other words, when the detected gradient is smaller than the predetermined value, the second check valve 48 is determined as being fixed to the valve opened position.

(4) In the abnormal diagnosis for the air flow of the above embodiments, the in-tank pressure is detected after the predetermined time has passed over since the purge control valve 46 is switched to the valve opened position. According to a modification, the in-tank pressure can be detected after the in-tank pressure is stabilized at a constant value (hereinafter, referred to as a saturated in-tank pressure), and the saturated in-tank pressure can be compared with a predetermined value, so as to carry out the abnormal diagnosis based on the change of the in-tank pressure.

(5) Instead of the structure of the above embodiments, in which the in-tank pressure is detected after the predetermined time has passed over since the purge control valve 46 is switched to the valve opened position, a time can be detected until such a time point at which the in-tank pressure reaches at a predetermined in-tank pressure and such time is compared with a predetermined time so as to carry out the abnormal diagnosis based on the change of the in-tank pressure.

Figure 8:
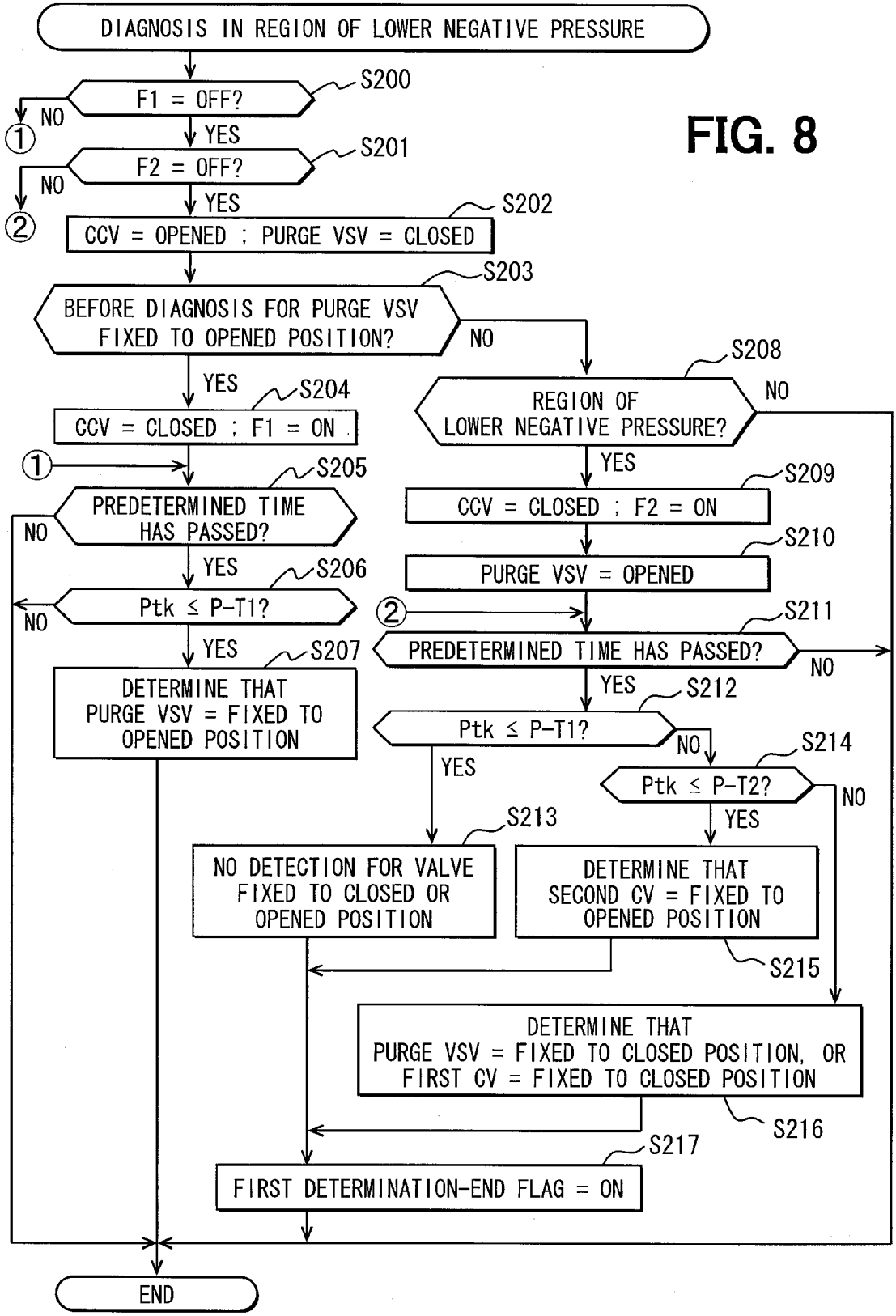
FIG. 8 is a flow-chart showing the process of abnormal diagnosis for air flow in the operating condition of the lower negative pressure.

For example, in the case of determining whether the second check valve 48 is fixed to the valve opened position or not in the operating condition of the lower negative pressure, that is, in the case of the step S214 of FIG. 8, a time is measured until the in-tank pressure detected by the pressure sensor 54 reaches at a predetermined value (for example, a value equal to the second threshold value "P-T2", an intermediate value between the second threshold value "P-T2" and the third threshold value "P-T3", or the like) after the purge control valve 46 is switched to the valve opened position. When the measured time is longer than the predetermined value, the second check valve 48 is determined as being fixed to the valve opened position.

(6) In the above embodiments, the abnormal diagnosis is carried out at first for the first operating condition and then, the abnormal diagnosis is sequentially carried out for the second and third operating conditions. However, the order for the abnormal diagnosis should not be limited to the above order. For example, the abnormal diagnosis can be carried out in an order of the second, the third and first operating conditions, or in another order of the third, the second and the first operating conditions. The order of the operating conditions for the abnormal condition can be changed depending on the operating condition of the engine 10. For example, the abnormal condition is carried out during the engine operation in such an order, in which the diagnosis is carried out for the operating condition which satisfies the execution conditions for carrying out the diagnosis for the corresponding operating condition.

(7) In the above embodiments, the abnormal diagnosis for the air flow is carried out for the three different operating conditions of the engine, so as to identify whether each of the multiple valves provided in the multiple purge passages is fixed to the valve opened or closed position.

According to a modification, the abnormal diagnosis may be carried out for one or two of the three different operating conditions, so as to determine which of the valves provided in the purge passages is not normally operated. For example, the abnormal diagnosis may be carried out for the first and second operating conditions to thereby identify the valve(s), which is (are) not normally operated. Alternatively, the abnormal diagnosis may be carried out for the first and third operating conditions to thereby identify the valve(s), which is (are) not normally operated.

(8) In the above embodiments, each of the upstream-side pressure and the downstream-side pressure of the throttle valve is determined whether such pressure is at the atmospheric pressure, the positive pressure or the negative pressure based on the detection by the intake-pressure sensor 16. More exactly, each of the first, the second and the third operating conditions is determined based on the pressure detected by the intake-pressure sensor 16.

According to a modification, another pressure sensor may be provided in the intake-air passage 11 at such a position of an upstream side of the throttle valve 14 but a downstream side of the intake-air compressor 31. And each of the first to third operating conditions is determined based on not only the pressure detected by the intake-pressure sensor 16 provided at the downstream side of the throttle valve 14 but also the pressure detected by the pressure sensor provided at the upstream side of the throttle valve 14.

Alternatively, a relationship between the downstream-side pressure of the throttle valve and the engine rotational speed as well as the engine load is preset in advance. And each of the first to third operating conditions is determined based on the engine rotational speed and the engine load. For example, when the engine rotational speed and the engine load are in an area of a low rotational speed and low load, the operational condition of the engine is determined as being in the first operating condition. When the engine rotational speed and the engine load are in an area of a middle rotational speed and middle load, the operational condition of the engine is determined as being in the second operating condition. When the engine rotational speed and the engine load are in an area of a high rotational speed and high load, the operational condition of the engine is determined as being in the third operating condition.

(9) In the abnormal diagnosis during the engine operation, the abnormal diagnosis for the purge control valve is carried out for each operating condition whether the purge control valve is fixed to the valve opened position or not. The diagnosis for the purge control valve (whether the purge control valve is fixed to the valve opened position or not) may be carried out only one time in the diagnosis process for the first operating condition (in the above embodiment, for the operating condition of the lower negative pressure).

In addition, in the above embodiments, the abnormal diagnosis for the purge control valve 46 whether it is fixed to the valve opened position or not is carried out before the abnormal diagnosis, which is carried out based on the change of the in-tank pressure in the condition that the air-communication valve 44 is closed and the purge control valve 46 is opened. However, the abnormal diagnosis for the purge control valve 46 whether it is fixed to the valve opened position or not can be alternatively carried out after the abnormal diagnosis, which is carried out based on the change of the in-tank pressure in the condition that the air-communication valve 44 is closed and the purge control valve 46 is opened.

(10) In the above embodiments, the in-tank pressure sensor 54 is provided in the fuel tank 25 in order to detect the in-tank pressure, which corresponds to a pressure of a space including the canister 41, the connecting pipe 42 and the purge pipe 45, which are arranged between the fuel tank 25 and the purge control valve 46. However, the position of the pressure sensor should not be limited to the fuel tank 25. For example, the pressure sensor 54 may be provided in the connecting pipe 42 between the fuel tank 25 and the canister 41 or in the purge pipe 45 between the canister 41 and the purge control valve 46.

(11) In the above embodiments, the turbocharger 30 is provided as the supercharging device. In place of the turbocharger 30, such a supercharging device may be provided, wherein the supercharging device is operated by a driving force of an output shaft of the engine 10 or operated by an electric actuator, such as an electric motor.

What is claimed is:

1. A vaporized-fuel processing system comprising:

an absorbing device for absorbing vaporized fuel generated in a fuel tank;

an air-communication valve provided in the absorbing device for cutting off supply of atmospheric air into the absorbing device when the air-communication valve is closed;

a purge control valve provided in a purge pipe which connects the absorbing device to an intake-air passage of an engine, the vaporized fuel of the absorbing device is purged into the intake-air passage when the purge control valve is opened;

a throttle valve provided in the intake-air passage for controlling an amount of intake air to be supplied into the engine;

a supercharging device provided in the intake-air passage at an upstream side of the throttle valve for supercharging the intake air;

a first and a second purge passage branched out from the purge pipe at a downstream side of the purge control valve, the first purge passage being connected to the intake-air passage at a downstream side of the throttle valve, and the second purge passage being connected to the intake-air passage at an upstream side of the supercharging device;

a first check valve provided in the first purge passage, the first check valve being opened by negative pressure generated in the intake-air passage at the downstream side of the throttle valve;

an ejector and a second check valve provided in the second purge passage, the ejector being operated by the intake air supercharged by the supercharging device and the second check valve being opened by an operation of the ejector;

a pressure sensor for detecting an in-tank pressure, which corresponds to a pressure of a space including the fuel tank, the absorbing device, a connecting pipe between the fuel tank and the absorbing device;

a determination unit for determining whether an upstream-side pressure of the throttle valve, which corresponds to a pressure of the intake air in the intake-air passage at the upstream side of the throttle valve, is at an atmospheric pressure, at a positive pressure with respect to the atmospheric pressure or at a negative pressure with respect to the atmospheric pressure, the determination unit further determining whether a downstream-side pressure of the throttle valve, which corresponds to a pressure of the intake air in the intake-air passage at the downstream side of the throttle valve, is at the atmospheric pressure, at the positive pressure or at the negative pressure; and a diagnostic unit for diagnosing abnormal conditions of the purge control valve, the first check valve and the second check valve, in order to identify which of the valves is not normally operated and whether such a valve is fixed to its valve opened position or to its valve closed position, wherein a diagnosing process of the diagnostic unit is carried out based on determination result of the determination unit and a change of the in-tank pressure detected by the pressure sensor, in a condition that the air-communication valve is closed and the purge control valve is opened.

2. The vaporized-fuel processing system according to claim 1, wherein the determination unit determines that an engine operation is in a first operating condition, when the upstream-side pressure of the throttle valve is at the atmospheric pressure and the downstream-side pressure of the throttle valve is at the negative pressure, the determination unit determines that the engine operation is in a second operating condition, when the upstream-side pressure of the throttle valve is at the positive pressure and the downstream-side pressure of the throttle valve is at the negative pressure, the determination unit determines that the engine operation is in a third operating condition, when the upstream-side pressure of the throttle valve as well as the downstream-side pressure of the throttle valve is at the positive pressure, the diagnostic unit detects the change of the in-tank pressure for each of the first, the second and the third operating conditions, in the condition that the air-communication valve is closed and the purge control valve is opened, in order to diagnose the abnormal conditions of the respective valves based on detected change of the in-tank pressure.

3. The vaporized-fuel processing system according to claim 2, wherein the diagnosing process is sequentially carried out for the respective engine operations in an order of the first operating condition, the second operating condition and the third operating condition.

4. The vaporized-fuel processing system according to claim 1, wherein the diagnosing process is carried out for a first operating condition of the engine operation, in which the upstream-side pressure of the throttle valve is at an atmospheric pressure and the downstream-side pressure of the throttle valve is at a negative pressure with respect to the atmospheric pressure, and the diagnostic unit diagnoses that the second check valve is fixed to the valve opened position, when the in-tank pressure detected by the pressure sensor is changed to a pressure decreasing side and a changed value of the in-tank pressure is smaller than a predetermined value of a normal condition.

5. The vaporized-fuel processing system according to claim 4, wherein the diagnosing process is carried out for the first operating condition of the engine operation in a condition that the purge control valve is controlled at an intermediate valve opening position, which is between a valve fully-opened position and a valve fully-closed position.

6. The vaporized-fuel processing system according to claim 1, wherein the diagnosing process is carried out for a second operating condition of the engine operation, in which the upstream-side pressure of the throttle valve is at a positive pressure with respect to an atmospheric pressure and the downstream-side pressure of the throttle valve is at a negative pressure with respect to the atmospheric pressure, and the diagnostic unit diagnoses that the first check valve is fixed to the valve closed position, when the in-tank pressure detected by the pressure sensor is changed to a pressure decreasing side and a changed value of the in-tank pressure is smaller than a predetermined value of a normal condition.

7. The vaporized-fuel processing system according to claim 1, wherein the diagnosing process is carried out for a second operating condition of the engine operation, in which the upstream-side pressure of the throttle valve is at a positive pressure with respect to an atmospheric pressure and the downstream-side pressure of the throttle valve is at a negative pressure with respect to the atmospheric pressure, and the diagnostic unit diagnoses that the purge control valve is fixed to the valve closed position, when the in-tank pressure detected by the pressure sensor is not substantially changed.

8. The vaporized-fuel processing system according to claim 1, wherein the diagnosing process is carried out for a third operating condition of the engine operation, in which the upstream-side pressure of the throttle valve and the downstream-side pressure of the throttle valve is at a positive pressure with respect to the atmospheric pressure, and the diagnostic unit diagnoses that the first check valve is fixed to the valve opened position, when the in-tank pressure detected by the pressure sensor is changed to a pressure increasing side.

9. The vaporized-fuel processing system according to claim 1, wherein the diagnosing process is carried out for a third operating condition of the engine operation, in which the upstream-side pressure of the throttle valve and the downstream-side pressure of the throttle valve is at a positive pressure with respect to the atmospheric pressure, and the diagnostic unit diagnoses that the second check valve is fixed to the valve closed position, when the in-tank pressure detected by the pressure sensor is not substantially changed.

10. The vaporized-fuel processing system according to claim 1, wherein a leak diagnosing unit is connected to the absorbing device for diagnosing whether there is any leak of the vaporized fuel from an evaporation system to the atmospheric air, the evaporation system is composed of the fuel tank, the absorbing device, and the connecting pipe between the fuel tank and the absorbing device, the leak diagnosing unit has the air-communication valve, which is composed of a switching valve having a first and a second valve position, the absorbing device is communicated to atmospheric air when the switching valve is in its first valve position, while the absorbing device is blocked out from the atmospheric air when the switching valve is in its second valve position, the leak diagnosing unit has a depressurizing device for decreasing the pressure in the evaporation system, and a reference orifice having a restriction with a reference leak diameter, wherein an abnormal diagnosis is carried out, during a period in which the engine operation is stopped, in order to diagnose whether the second check valve is fixed to the valve opened position and whether the first check valve is fixed to the valve opened position, based on the change of the in-tank pressure detected by the pressure sensor, and wherein the abnormal diagnosis is carried out in a condition that the pressure in the evaporation system is decreased by the depressurizing device, the switching valve is changed to the second valve position and the purge control valve is opened.

11. A vaporized-fuel processing system comprising:

an absorbing device for absorbing vaporized fuel generated in a fuel tank;

an air-communication valve of a normally-opened type provided in the absorbing device for cutting off supply of atmospheric air into the absorbing device when the air-communication valve is closed;

a purge control valve of a normally-closed and an electromagnetic type provided in a purge pipe which connects the absorbing device to an intake-air passage of an engine, the vaporized fuel of the absorbing device is purged into the intake-air passage when the purge control valve is opened upon receiving electric power;

a throttle valve provided in the intake-air passage for controlling an amount of intake air to be supplied into the engine;

a supercharging device provided in the intake-air passage at an upstream side of the throttle valve for supercharging the intake air;

a first and a second purge passage branched out from the purge pipe at a downstream side of the purge control valve, the first purge passage being connected to the intake-air passage at a downstream side of the throttle valve, and the second purge passage being connected to the intake-air passage at an upstream side of the supercharging device;

a first check valve provided in the first purge passage, the first check valve being opened by negative pressure generated in the intake-air passage at the downstream side of the throttle valve;

an ejector and a second check valve provided in the second purge passage, the ejector being operated by the intake air supercharged by the supercharging device and the second check valve being opened by an operation of the ejector;

a pressure sensor for detecting an in-tank pressure, which corresponds to a pressure of a space including the fuel tank, the absorbing device, a connecting pipe between the fuel tank and the absorbing device;

a determination unit for determining whether an upstream-side pressure of the throttle valve, which corresponds to a pressure of the intake air in the intake-air passage at the upstream side of the throttle valve, is at an atmospheric pressure, at a positive pressure with respect to the atmospheric pressure or at a negative pressure with respect to the atmospheric pressure, the determination unit further determining whether a downstream-side pressure of the throttle valve, which corresponds to a pressure of the intake air in the intake-air passage at the downstream side of the throttle valve, is at the atmospheric pressure, at the positive pressure or at the negative pressure; and a diagnosing unit for diagnosing an abnormal condition for the purge control valve whether the purge control valve is fixed to its valve opened position, wherein the diagnosing unit determines that the purge control valve is fixed to the valve opened position when the in-tank pressure is detected in a condition that the air-communication valve is closed and no electric power is supplied to the purge control valve and when such detected in-tank pressure is lower than a predetermined pressure, wherein the diagnostic unit further diagnoses abnormal conditions of the purge control valve, the first check valve and the second check valve, in order to identify which of the valves is not normally operated and whether such a valve is fixed to its valve opened position or to its valve closed position, wherein a diagnosing process of the diagnostic unit is carried out based on determination result of the determination unit and a change of the in-tank pressure detected by the pressure sensor, in a condition that the air-communication valve is closed and the purge control valve is opened.

* * * * *